US005170158A

United States Patent [19]

Shinya

[11] Patent Number: 5,170,158

[45] Date of Patent: Dec. 8, 1992

[54] DISPLAY APPARATUS

[75] Inventor: Masako Shinya, Tokyo, Japan

[73] Assignee: Kabushiki Kaisha Toshiba, Kawasaki, Japan

[21] Appl. No.: 544,533

[22] Filed: Jun. 28, 1990

[30] Foreign Application Priority Data

Jun. 30, 1989 [JP] Japan ..... 1-169569
Oct. 2, 1989 [JP] Japan ..... 1-255271

[51] Int. Cl.[5] ..... G09G 1/02
[52] U.S. Cl. ..... 340/800; 340/784
[58] Field of Search ..... 340/800, 802, 784, 805, 340/811, 801, 803, 718, 719; 350/332, 333; 358/241, 236

[56] References Cited

U.S. PATENT DOCUMENTS

| | | | |
|---|---|---|---|
| 4,210,934 | 7/1980 | Kutaragi | 358/241 |
| 4,257,068 | 3/1981 | Johnston | 340/800 |
| 4,571,584 | 2/1986 | Suzuki | 340/784 |
| 4,574,282 | 3/1986 | Crossland et al. | 350/333 |
| 4,646,074 | 2/1987 | Hashimoto | 340/718 |
| 4,742,346 | 5/1988 | Gillette et al. | 340/784 |
| 4,748,510 | 5/1988 | Umezawa | 358/241 |
| 4,870,399 | 9/1989 | Carlson | 340/784 |

FOREIGN PATENT DOCUMENTS 2-189579 7/1990 Japan .

OTHER PUBLICATIONS

OKI Semiconductor Handbook, "MSM 5280/5281GS—The Segment driver for TFT-LCD".
SID 88 Digest (pp. 232-234), "A1 Mega-Pixel Color a-Sift Liquid-Crystal Display" Castlebery et al, 1988.
Electronics Update, 1989, LSIH 5027A/5028, Japanese Translation.

*Primary Examiner*—Alvin E. Oberley
*Assistant Examiner*—Xiao Min Wu
*Attorney, Agent, or Firm*—Cushman, Darby & Cushman

[57] ABSTRACT

A display device has a driver circuit for driving data lines in a matrix display panel according to input digital signals. The driver circuit includes a number of digital-to-analog (D/A) converters, which number is less than the number of pixels contained in one horizontal scanning line. The D/A converters are repeatedly used to sequentially convert portions of the input digital image signal corresponding to one horizontal scanning line. The analog signals obtained by each D/A conversion are retained by a sample-and-hold circuit. When storage for one horizontal scanning line is completed, the signals are simultaneously delivered to the data lines. Therefore the display device can be reduced to a small circuit size. Also the offset voltage of the sample-and-hold circuitry can be reduced, since the outputs from the D/A converters can be sampled at an interval longer than the interval between pixels in the input digital signals.

7 Claims, 29 Drawing Sheets

DISPLAY APPARATUS

BACKGROUND OF THE INVENTION

1. Field of the Invention

The present invention relates to a display apparatus which uses a display panel having a matrix form. More particularly this invention relates to a display apparatus having a driving circuit which drives a data line of the display panel.

2. Description of the Related Art

A matrix liquid crystal display, especially an active matrix liquid crystal display, is generally constructed as shown in FIG. 1, where a matrix display panel 1 comprises a plurality of liquid crystal display elements arranged in rows and columns at intersections of data lines 2 extending vertically, i.e., in the Y direction, and address lines 3 extending horizontally, i.e., in the X direction. The liquid crystal display is shown to be equipped only with capacitors 4 and switching devices 5. Capacitors 4 retain the activating voltage applied to the liquid crystal. Switching devices 5 control the supply of the activating voltage to capacitors 4. In practice, matrix display panel 1 further includes display electrodes corresponding to pixels, a common transparent electrode corresponding to the display electrodes, and a liquid crystal layer sandwiched between each display electrode and the common transparent electrode. The activating voltage is applied to the display electrodes.

An X-driver circuit 6 drives data lines 2 according to image signals. A Y-driver circuit 7 drives address lines 3 according to scanning signals. In particular, X-driver circuit 6 receives an image signal corresponding to one horizontal scanning line and activates plural data lines 2 simultaneously. Y-driver circuit 7 activates address lines 3 successively each time data lines 2 are activated. Thus, the horizontal scanning lines of display panel 1 are driven successively.

Where the image signal applied to the display device takes a digital form, X-driver circuit 6 is required to convert its input digital image signal into analog form which is used to drive data lines 2. The prior art X-driver circuit having a digital-to-analog converter function comprises N stages of shift registers, N latch circuits for retaining an input digital image signal corresponding to one horizontal scanning line, and N D/A converters which receive the output signals from the N latch circuits and convert the signals into analog form.

In the X-driver circuit of this structure, the number of D/A converters must be identical to the number of pixels N contained in the horizontal scanning line. Therefore, if the number of pixels N contained in one horizontal scanning line for an input digital signal is large, or if the number of bits per pixel is large, then the X-driver circuit must be made very large. If this driver circuit is fabricated as an integrated circuit (IC), the area of the chip increases.

Where the input image signal takes an analog form, the X-driver circuit includes N sample-and-hold circuits which are connected to the input image signal in parallel and are sequentially enabled so that each sample-and-:old circuit holds the input image signal corresponding to one pixel in each horizontal scanning line. The image signals are then delivered simultaneously to data lines 2. In this case, when the number of pixels N contained in one horizontal scanning line is large, the sampling interval of the sample-and-hold circuits must be made short so as to sample-and-hold only image signals coming from corresponding pixels.

In order to reduce the sampling period of the sample-and-hold circuits, it is necessary either to increase the width of the gate of the sampling transistor (normally a MOS transistor) to reduce the resistance or to reduce the capacitance of each holding capacitor. As a result, the offset voltage of the sample-and-hold circuits increases. That is, the sampling period and the offset voltage of the sample-and-hold circuits have a conflicting relation to each other. Therefore, if the sampling interval is shortened, the offset voltage increases, thus deteriorating the image quality.

SUMMARY OF THE INVENTION

It is an object of the present invention to provide a display device which has a small circuit size and a low offset voltage.

The number of D/A converters included in the driver circuit driving the data lines in a matrix display panel according to input digital signals is made less than the number of pixels contained in one horizontal scanning line to reduce the circuit size. The operating speed of means for holding analog image signals is made low to reduce the offset voltage.

In one feature of the invention, the display device has a first driver circuit for driving data lines. D/A converters, the number of which is less than the number of pixels contained in one horizontal scanning line, repeatedly process an input digital image signal corresponding to one horizontal scanning line. An analog signal obtained by each digital-to-analog conversion is retained. When storage of analog image signals corresponding to one horizontal scanning line is completed, the signals are simultaneously delivered to the data lines.

In one embodiment of the invention, the first driver circuit comprises M D/A converters (M is less than the number of pixels N represented by the input digital image signal corresponding to one horizontal scanning line), digital storage means for storing an input digital signal corresponding to at least one horizontal scanning line, analog holding means, and means for simultaneously delivering the analog image signals held in the analog holding means to plural data lines.

The digital storage means distributes M pixels of digital data to the M D/A converters simultaneously. The analog holding means has the same number of sample-and-hold circuits as the number of pixels N contained in at least one horizontal scanning line. The sample-and-hold circuits hold analog image signals delivered from the D/A converters, corresponding to the plural data lines.

In another embodiment of the invention, digital storage means are provided to simultaneously retain N pixels of the input digital image signal at a time, corresponding to one horizontal scanning line, and to distribute each group of M bits to M D/A converters simultaneously. This operation is repeated plural times.

In one feature of the invention, an input digital image signal corresponding to one horizontal scanning line is applied to M D/A converters for conversion into analog form, M being less than the number of pixels N contained in one horizontal scanning line. This application is repeated N/M times. Hence, the number of the D/A converters is reduced, and the circuit size is reduced. Consequently, the novel device can be easily fabricated in the form of an IC.

The frequency at which digital image signals are applied to the group of M D/A converters is less than the frequency at which data for each pixel occurs in the digital image signal. Therefore the sample-and-hold circuits constituting the analog holding means may sample the outputs from the D/A converters for a time that is longer than the period in which digital data for each pixel occurs in the digital image signal. Therefore, the sampling period can be set to a long period. Also, the offset voltage can be reduced.

BRIEF DESCRIPTION OF THE DRAWINGS

FIG. 1 is a block diagram of a display apparatus which uses a liquid display panel having a matrix from;

DETAILED DESCRIPTION OF THE PREFERRED EMBODIMENTS

Examples of the invention are hereinafter described with reference to the drawings.

Figure 2:
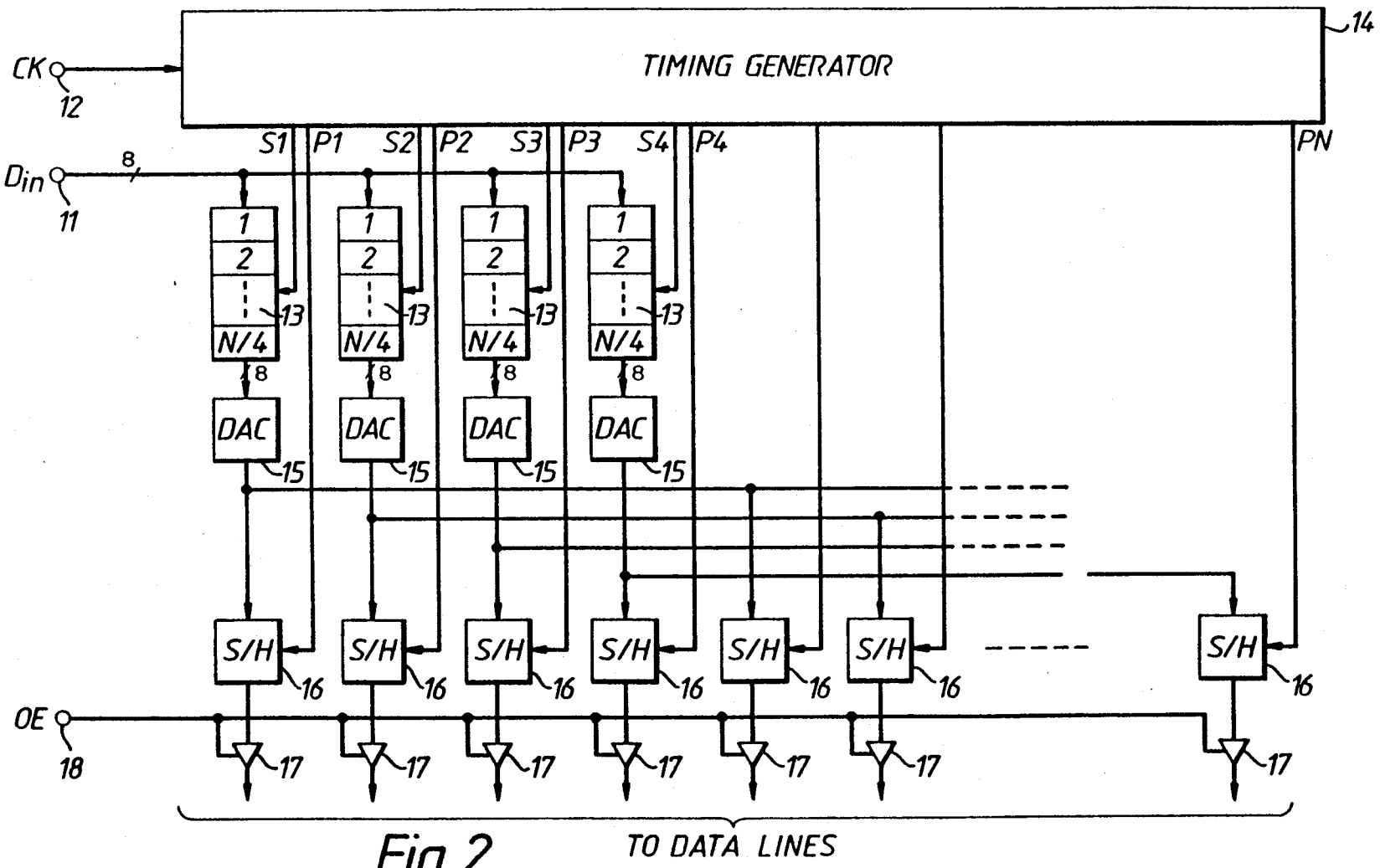
FIG. 2 is a block diagram of a first embodiment of a driver circuit according to the present invention.
Figure 3:
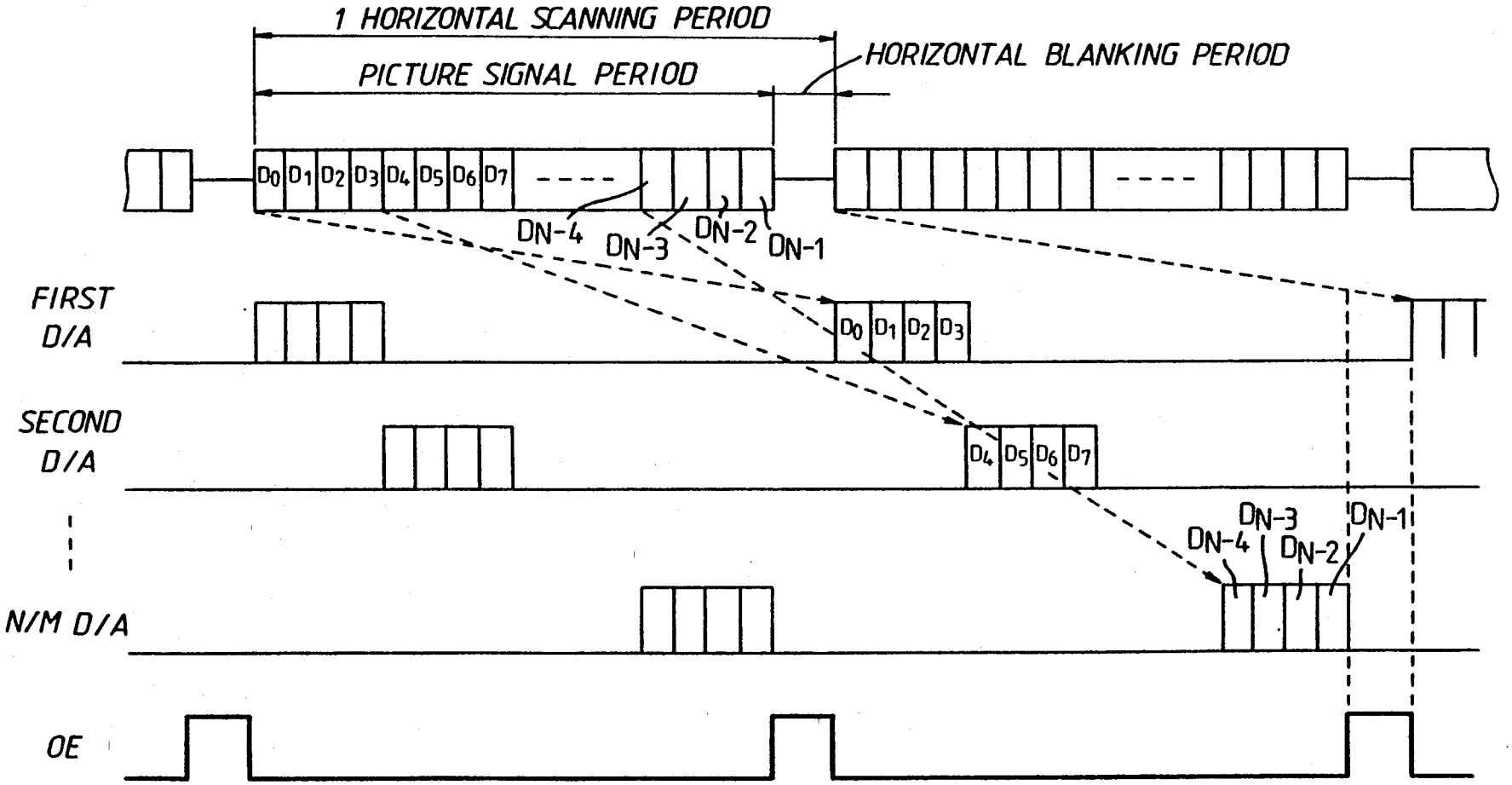
FIGS. 3 and 4 are timing charts to explain the operation of FIG. 2 according to the present invention.
Figure 4:
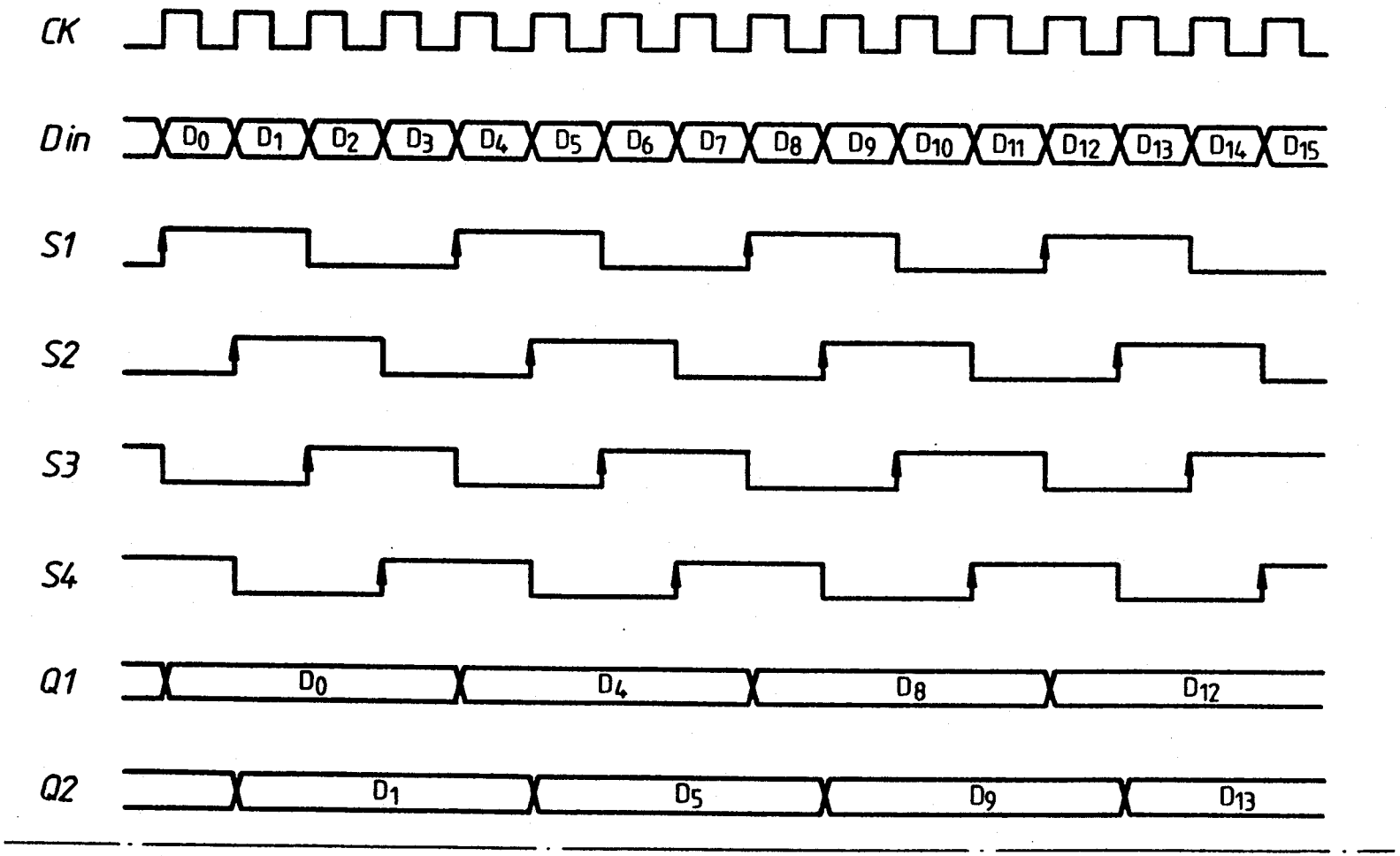
Figure 4:
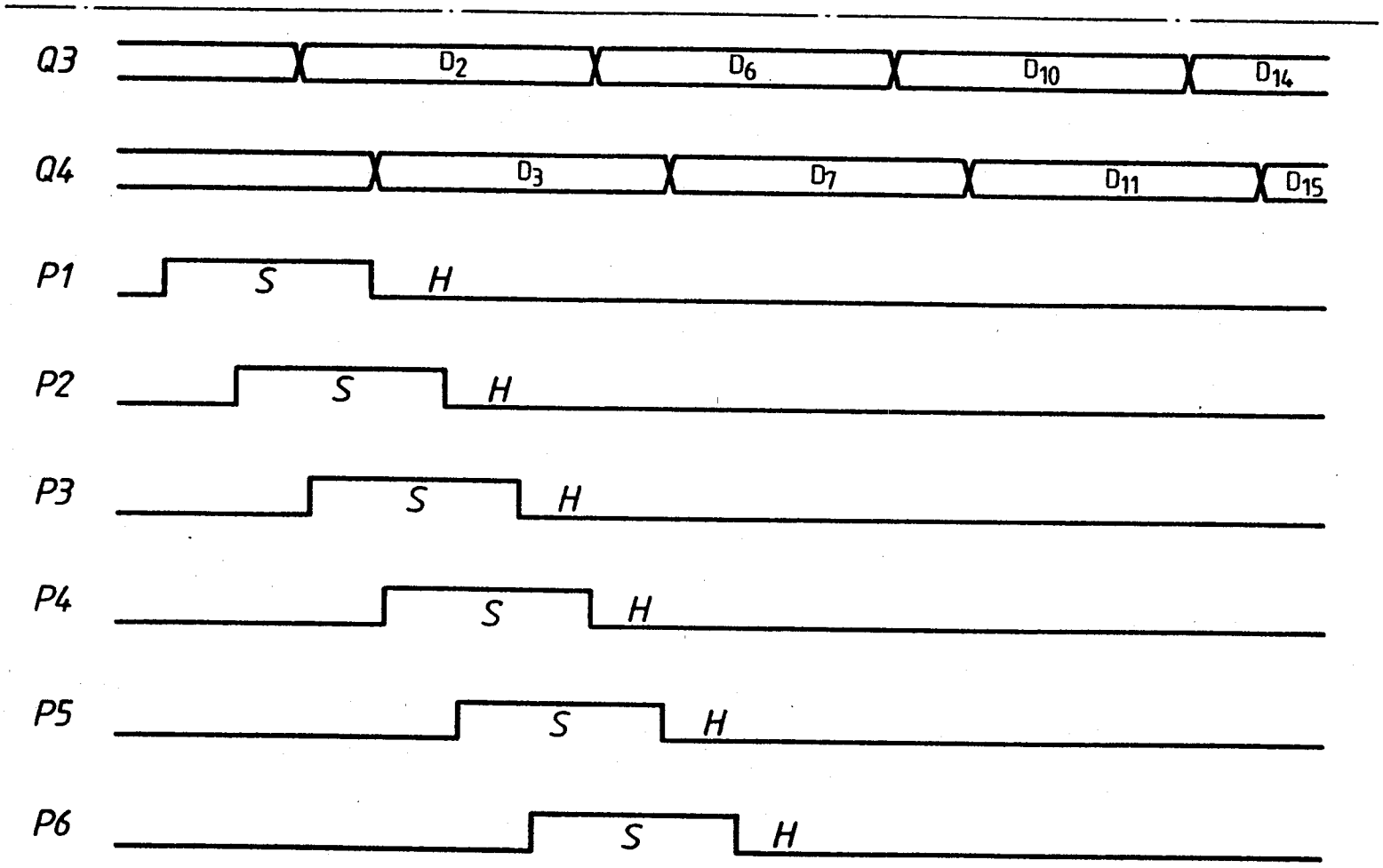

FIG. 2 shows the internal structure of an X-driver circuit, or a first driver circuit according to the invention. FIGS. 3 and 4 are timing diagrams illustrating the operation of the driver circuit shown in FIG. 2.

The driver circuit shown in FIG. 2 comprises n-bit, N/M stage, M shift registers 13, a timing generating circuit 14, M D/A converters 15, N sample-and-hold circuits 16, and N output buffers 17. Shift registers 13 act as digital storage means for retaining an input digital image signal Din applied to a terminal 11, the signal Din corresponding to one line of data.

The number n is the number of bits of the input digital image signal Din per pixel. N is the number of pixels of one horizontal scanning line and is equal to the number of data lines 2 shown in FIG. 2. M is the number of D/A converters 15. In this example, $n=8$ and $M=4$.

The input digital image signal Din is applied to the first stage of each of the M shift registers 13 and is delivered from the final stage of each shift register 13.

A clock signal CK, synchronized with the input digital image signal Din, is applied to a terminal 12 and is supplied to timing generating circuit 14. Timing generating circuit 14 produces transfer clock pulses $S_1$–$S_4$ to shift registers 13, sampling pulses $P_1$–$P_N$ to sample-and-hold circuits 16, clock pulses to D/A converters 15, and other pulses. Timing generating circuit 14 is connected with D/A converters 15 by lines (not shown).

When an output enable signal OE is applied to a terminal 18, output buffers 17 cause the output signals from the sample-and-hold circuits 16 to be simultaneously fed to data lines 2 shown in FIG. 2.

FIG. 3 shows the relation among the input digital image signal Din, the operation of D/A converters 15, and the output enable signal OE. As shown in FIG. 3, when the input digital image signal Din corresponding to one horizontal scanning line is applied, the M D/A converters 15 convert data $D_1$ through $D_{1+3}$ ($i=0, 1, 2, N-4$), related to M successive pixels, into analog form. This conversion is repeated N/M times. Thus, the digital-to-analog conversion for one horizontal scanning line is completed. Since the digital image signals are applied to D/A converters 15 via shift registers 13, these signals are delayed by one horizontal scanning period with respect to the digital image signal Din applied to terminal 1.

After the digital image signals corresponding to one horizontal scanning line are converted into analog form by D/A converters 15 and the resulting analog image signals are retained by sample-and-hold circuits 16, output enable signal OE causes output buffers 17 to transfer analog image signals corresponding to one horizontal scanning line to the data lines simultaneously.

This operation is now described in detail by referring to FIG. 4. The transfer clock pulses $S_1$ to $S_4$ supplied to the four shift registers 13 have a period that is four times longer than the period of clock pulses CK. The transfer clock pulses are successively shifted in phase by one period of the clock pulses CK. The transfer clock pulses $S_1$–$S_4$ cause the four shift registers 13 to transfer data.

That is the first stages of the shift registers accept the digital image signal Din corresponding to four pixels at a time such that the four pixels accepted by each successive register differs by one pixel. Each shift register 13 delivers the digital image signal from its final stage in such a way that the first accepted signal is delivered first.

Specifically, the four shift registers 13 first accept data $D_0$–$D_3$ related to the first through fourth pixels. Then, the registers accept data $D_4$–$D_7$ related to the fifth through eighth pixels. The registers then accept data $D_8$–$D_{11}$ related to the ninth through twelfth pixels. In this way, the registers successively accept data related to groups of four successive pixels. Each register accepts data about every fourth pixel such as $D_0$, $D_4$, $D_8$, etc., and delivers the data such that the first accepted data is delivered first. This can be seen from $Q_1$–$Q_4$ of FIG. 4 which shows the output signals from the four shift registers 13. In practice, the contents of $Q_1$–$Q_4$ of FIG. 4 are data about the input digital image signal Din obtained one horizontal scanning period earlier.

In this way, the four shift registers 13 deliver data about the digital image signal every four pixels. The data are converted into analog form by the four D/A converters 15. The analog image signals delivered from D/A converters 15 are applied to sample-and-hold circuits 16 and are sampled in response to sampling pulses $P_1$, $P_2$, $P_3$, etc., shown in FIG. 4.

Sample-and-hold circuits 16 correspond to N data lines 2 shown in FIG. 2 in a 1:1 relation. Sample-and-hold circuits 16 are connected with D/A converters 15 in such a way that the analog signals converted from the data $D_0$, $D_1$, $D_2$, $D_{N-1}$ represented by the digital image signal Din are correctly supplied onto data lines 2. More specifically, the 4K-th (K=1, 2, N−4) sample-and-hold circuit as viewed from the left is connected with the first D/A converter. The (4K+1)th sample and-hold circuit is connected with the second D/A converter. The (4K+2)th sample-and-hold circuit is connected with the third D/A converter. The (4K+3)th sample-and-hold circuit is connected with the fourth D/A converter.

The digital to analog conversion of data related to four successive pixels is repeated N/4 times by D/A converters 13. After analog image signals corresponding to one horizontal scanning line are held in the N sample-and-hold circuits 16, output enable signal OE is applied to terminal 18 in a horizontal blanking period. Then, output buffers 17 are turned on to produce analog image signals simultaneously on data lines 2.

In the above structure, the number of D/A converters 13 M is less than the number of pixels N contained in one horizontal scanning line, it being noted that the D/A converters are the major components of the X-driver circuit. Hence, the size of the circuit is much smaller than the prior art X-driver circuit which needs a number of D/A converters corresponding to the number of pixels in one horizontal scanning line. Consequently, when the X-driver circuit is fabricated in the form of an IC, the chip can be made small.

Figure 5:
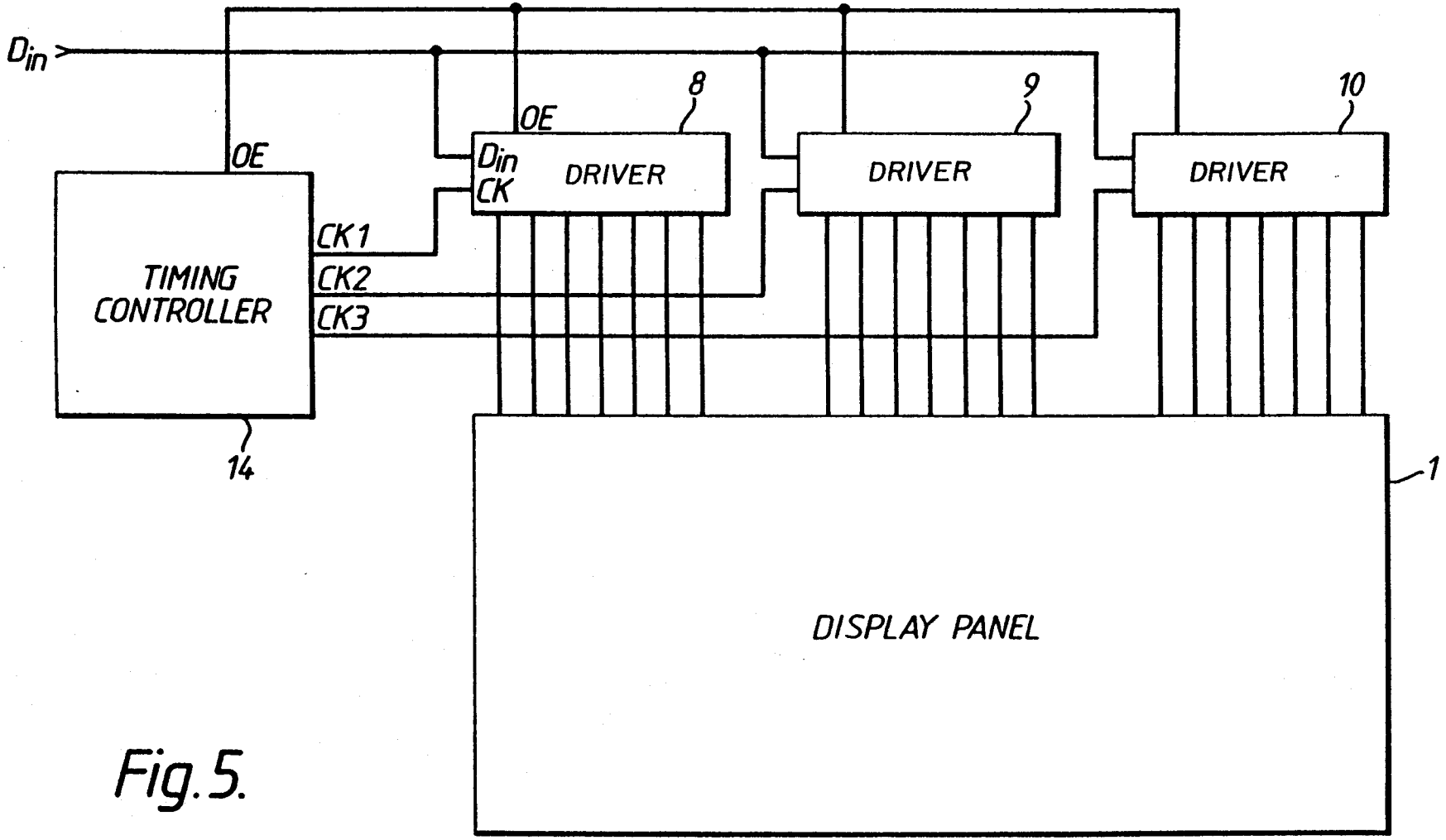
FIG. 5 shows a block diagram of a display device configuration with the X-driver ICs illustrated in FIG. 2.

If N is large and more than one X-driver IC is needed, the X-driver ICs are connected with the timing controller 14 and the liquid display panel as shown in FIG. 5. In FIG. 5 each of CK1–3 corresponding to X-drivers 8–10, is applied during the appropriate period while the data to be processed in each IC are supplied to it.

Since the analog image signals from D/A converters 13 are applied to the N sample-and-hold circuits 16 every M pixels, i.e., at long intervals of time, the sampling period can be M times longer than the period used when an input analog image signal for each pixel is directly applied to all sample-and-hold circuits, using the prior art techniques. Therefore, it is not necessary to increase the gate width of sampling MOS transistors or to reduce the capacitance of each holding capacitor to reduce the sampling period. Thus, the offset voltage of sample-and-hold circuits 16 can be maintained low.

Figure 6:
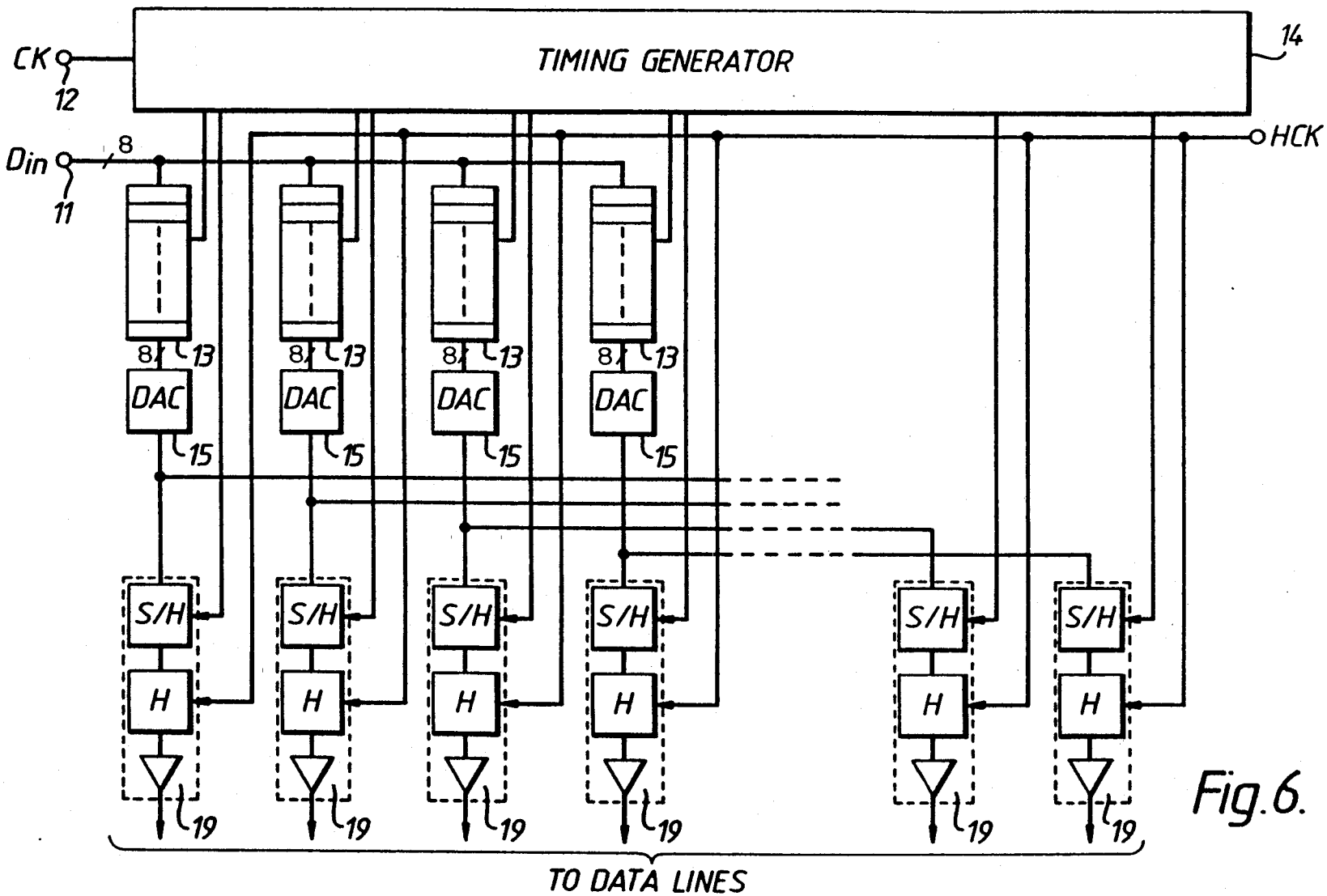
FIG. 6 is a block diagram of a second embodiment of a driver circuit according to the present invention.

FIG. 6 shows an X-driver circuit constituting a second example of the present invention. This example differs from the first example in that sample-and-hold circuits 16 and output buffers 17 shown in FIG. 2 are replaced by sample-and-hold circuits 19 having a double holding function.

In the first example, output signals from sample-and-hold circuits 16 are transferred to the data lines via output buffers 17 during each horizontal blanking period. The second example makes use of sample-and-holding circuits 19 having a double holding function. The display device configuration shown in FIG. 5 may also be applied, but the OE signal is used as the HCK signal in FIG. 6. The analog image signal on the present horizontal scanning line is delivered to the data lines while the analog image signal on the next horizontal scanning line is being introduced into sample-and-hold circuits 19.

Figure 1:
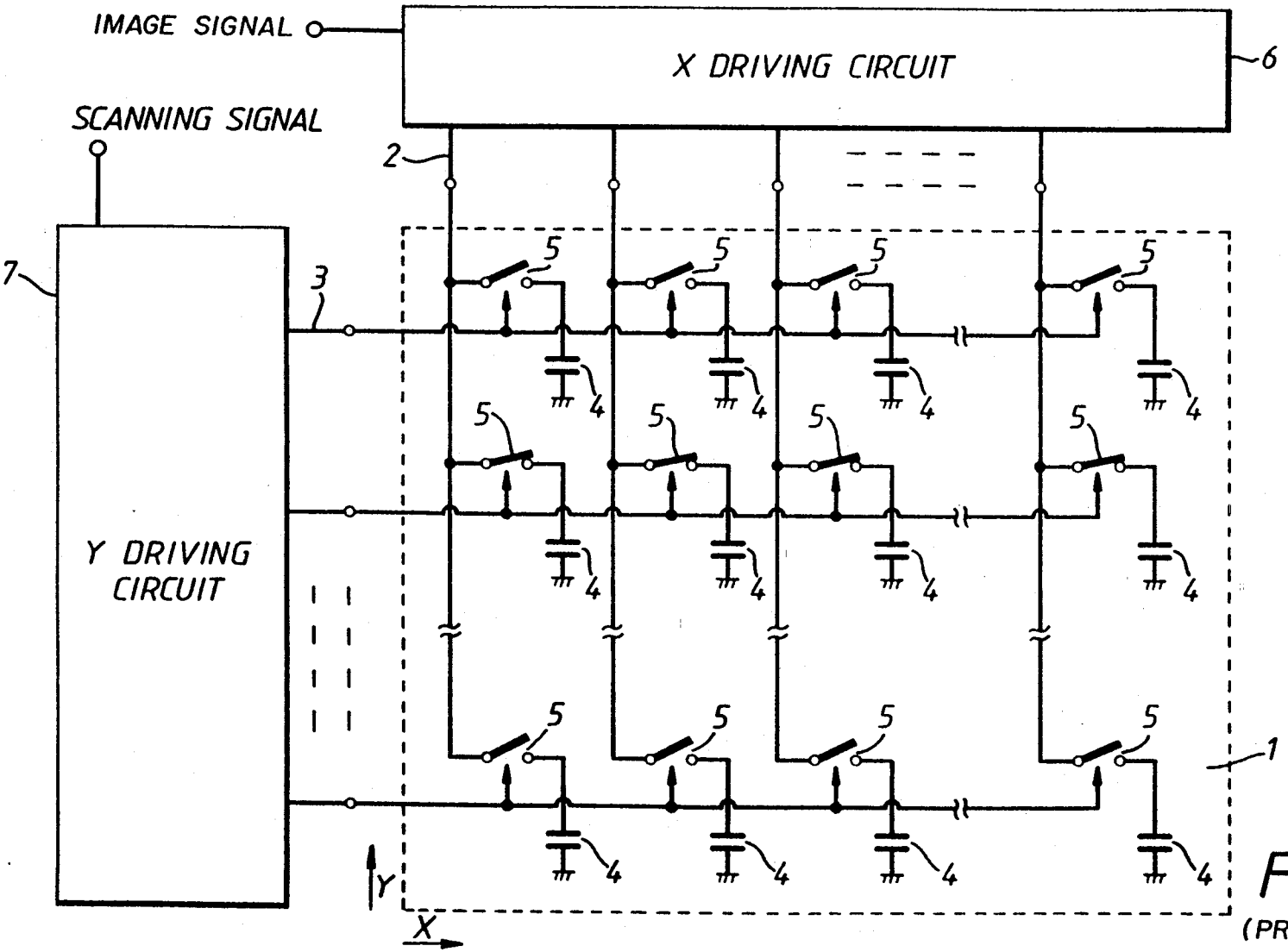
Fig. 1. (PRIOR ART)

Since image signals are delivered to the data lines for a long time, more image signal charge can be stored in capacitors 4 shown in FIG. 1. This enables a high quality display to be provided which in not affected by noise. Also, the slew rate of the output to the data lines can be lowered, thus reducing the amount of electric power consumed.

Figure 7:
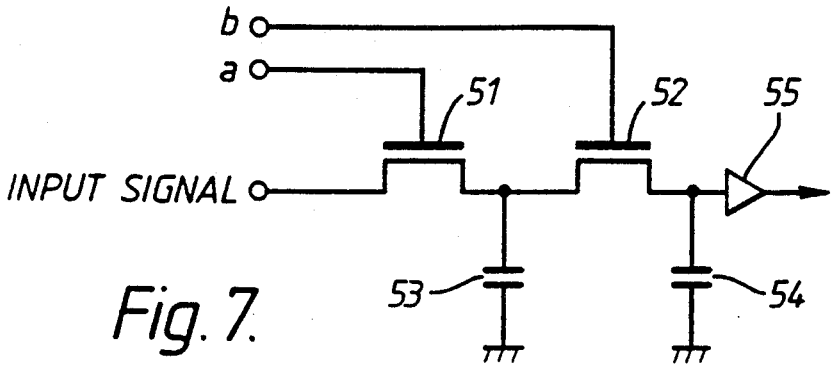
FIGS. 7–9 are alternative sample and hold circuits having a double retention function according to the present invention.
Figure 8:
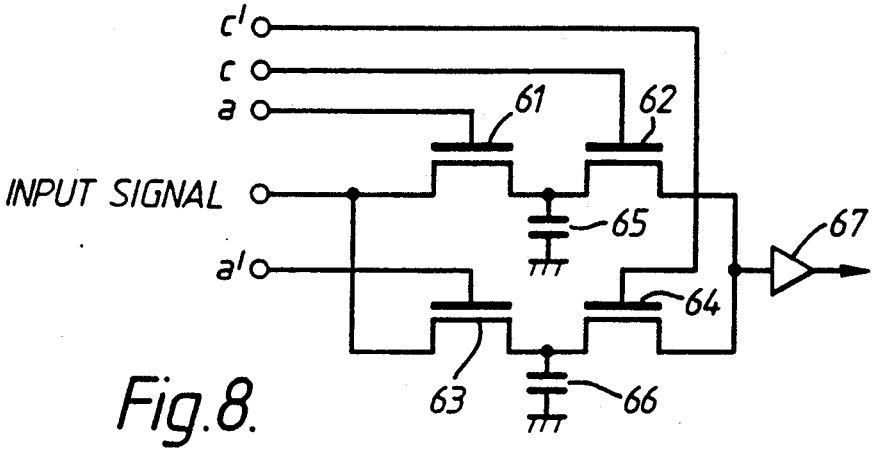
Figure 9:
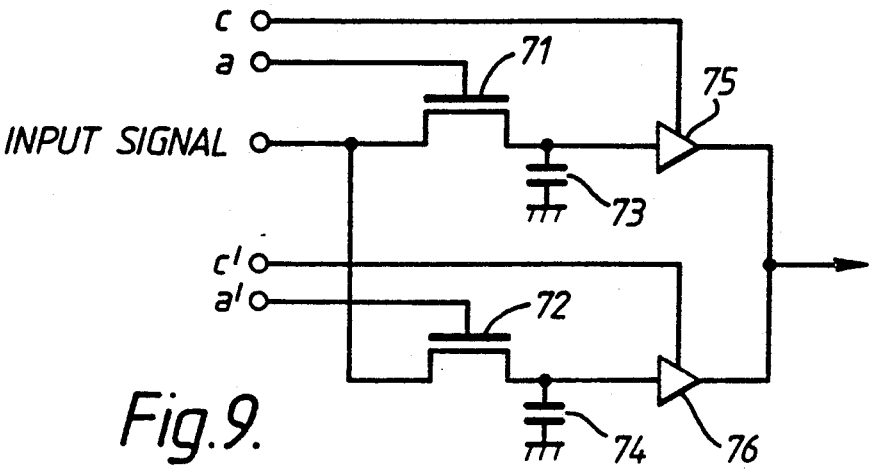

FIGS. 7, 8, and 9 show specific examples of sample-and-hold circuits having the double holding function. In FIG. 7 a first sampling switch 51 is first turned on by control signal a. An analog image signal is held in a first holding capacitor 53. At this time, a second sampling switch 52 is off. An image signal produced one horizontal scanning line previously is retained in a second holding capacitor 54 and continues to be delivered to the corresponding data line via output buffer 55.

After the image signal corresponding to one horizontal scanning line is converted into analog form, control signal b turns on second sampling switch 52 during a horizontal blanking period. The image signal already held in first holding capacitor 53 is transferred to second capacitor 54.

Referring to FIG. 8, control signal a turns on a first sampling switch 61 so that an analog image signal may be held in a first holding capacitor 65. In this case, control signals c and c′ make a second sampling switch 62 off and a fourth sampling switch 64 on, respectively. An image signal produced one horizontal scanning line previously is held a second holding capacitor 66 and continues to be delivered to the corresponding data line via an output buffet 67.

During the next horizontal scanning period, control signal a′ turns on a third sampling switch 63 to hold the image signal in second holding capacitor 66. Control signals c and c′ are inverted. Thus, second sampling switch 62 is turned on and fourth sampling transistor 64 is turn off. The image signal previously held in first holding capacitor 65 is delivered via output buffer 67.

Referring to FIG. 9, control signal a turns on a first sampling switch 71 to hold an analog image signal in a first holding capacitor 73. At this time, control signal a′ keeps a second sampling switch 72 off. Control signals c and c′ keep a first output buffer 75 off and a second output buffer 76 on, respectively. An image signal which was produced one horizontal scanning line previously and held in a second holding capacitor 74 continues to be delivered to the corresponding data line.

During the next horizontal scanning period, control signal a′ turns on second sampling switch 72. An image signal is retained in second holding capacitor 74. Control signals c and c′ are inverted. First output buffer 75 is turned on, and second output buffer 76 is turned off.

The image signal held in first holding capacitor 73 is delivered via output buffer 75.

Figure 10:
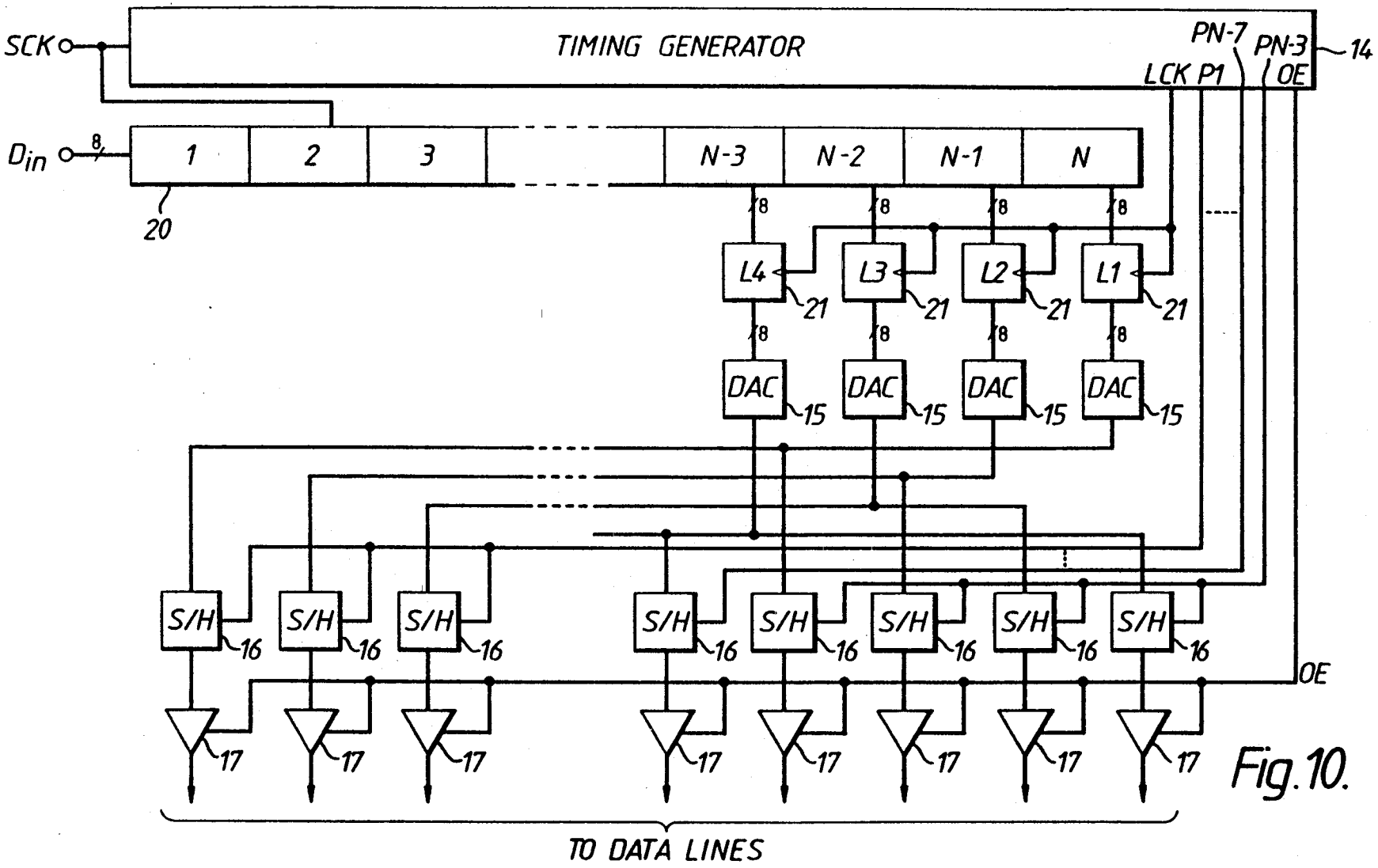
FIG. 10 is a block diagram of a third embodiment of a driver circuit according to the present invention.
Figure 11:
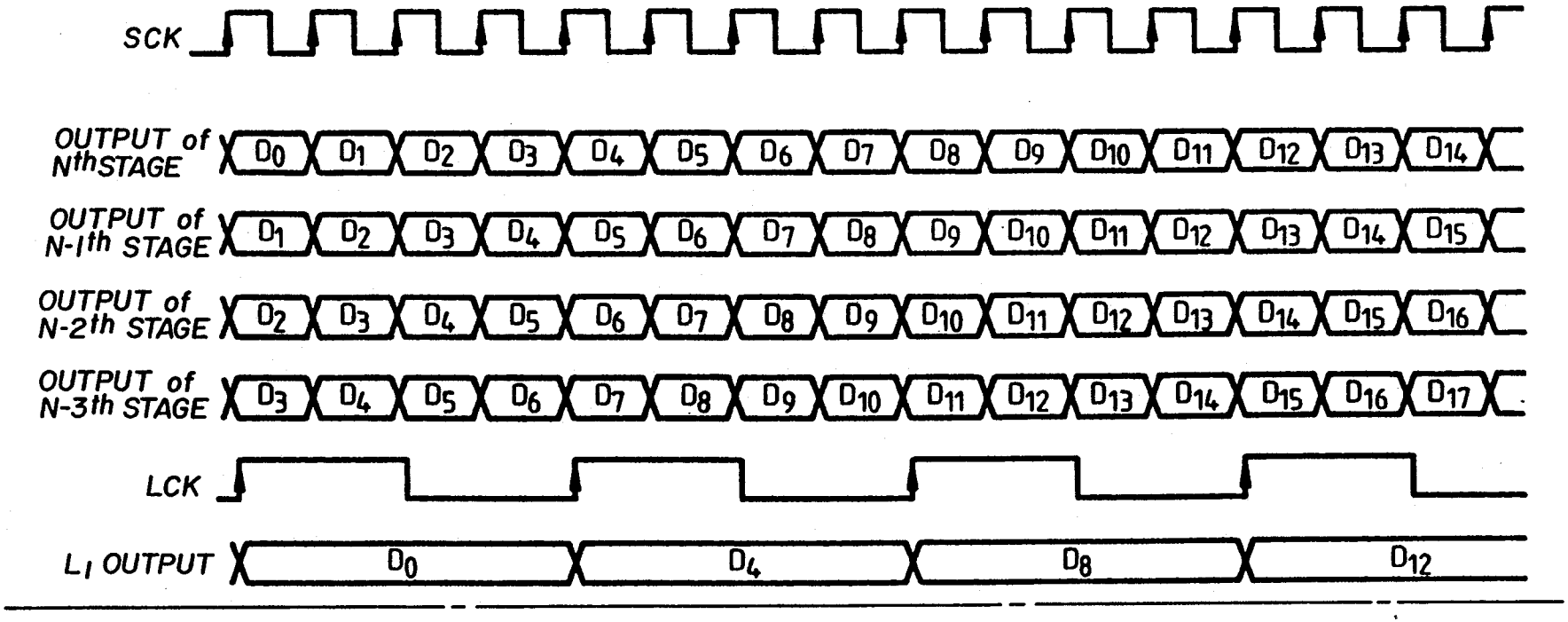
FIG. 11 is a timing diagram to explain the operation of FIG. 10.
Figure 11:
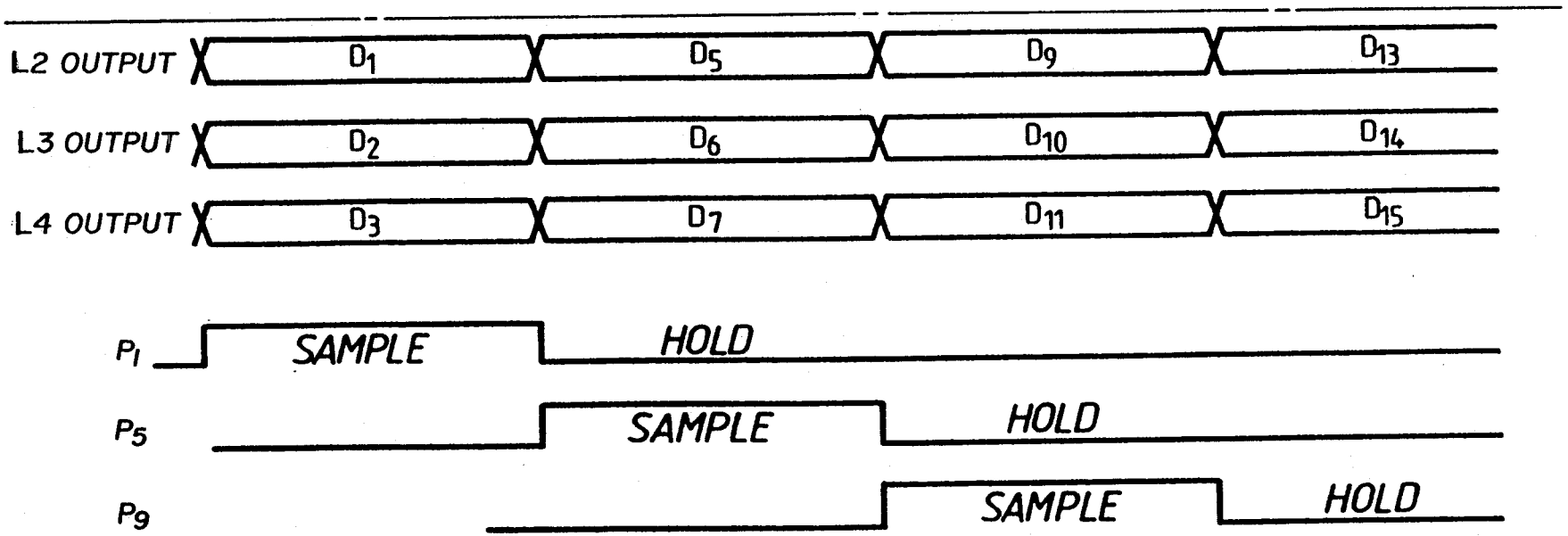

A third example of the invention is next described by referring to FIG. 10. FIG. 11 shows its timing diagram. In the examples described in conjunction with FIGS. 2 and 5, M (=4) shift registers are used to hold input digital image signal corresponding to one horizontal scanning line. In the third example, an n-bit, N-stage shift register 20 is employed. Input digital image signal Din enters the first stage of shift register 20 and is delivered from M final stages (in this example M=4). Then the signal is latched by M (=4) latches 21 with the clock signal LCK which has a period 4 times longer than the period of the clock signal SCK for shift register 20. After that, the signal is applied to M (=4) D/A converters 15. The analog image signals produced by D/A converters 15 are sampled and held by the following M corresponding sample-and-hold circuits 16.

Similar operations are subsequently carried out. When analog image signals corresponding to one horizontal scanning line are held in sample-and-hold circuits 16, output enable signal OE turns on output buffer 17 during a horizontal synchronization period. The analog image signal is delivered to the data lines simultaneously.

As in the previous examples, the sampling period of sample-and-hold circuits 17 is M (=4) times longer than the original clock signal, so that the offset voltage caused in sample-and-hold circuits 17 can be reduced.

Sample-and-hold circuits 16 and output buffers 17 may be replaced by sample-and-hold circuits 19 described in the second example and having a double holding function.

In the present example, the number of D/A converters is small, in the same manner as in the first and second examples. Hence, the size of the circuit can be made small.

Figure 12:
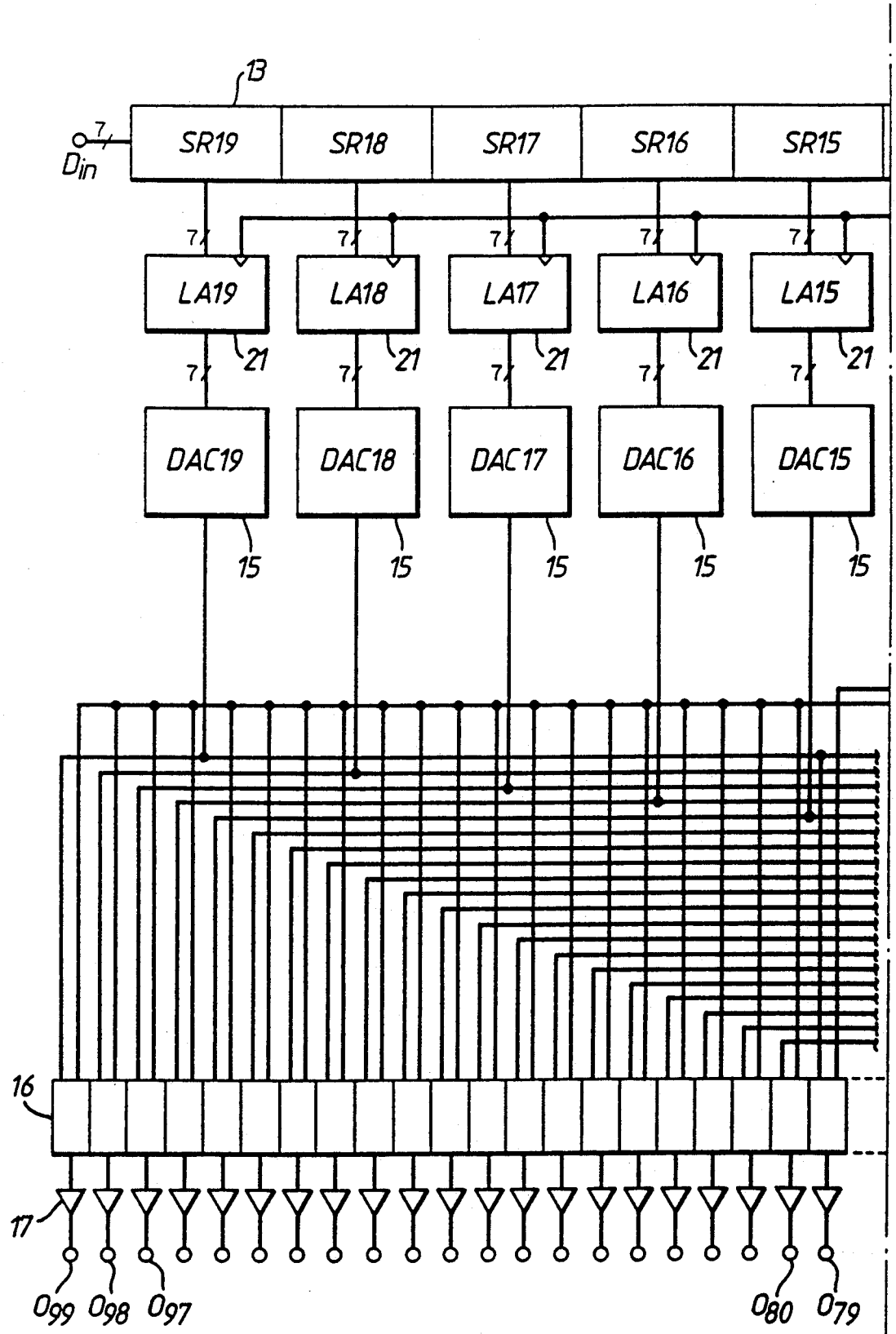
FIG. 12 is a block diagram of a fourth embodiment of a driver circuit according to the present invention.
Figure 12:
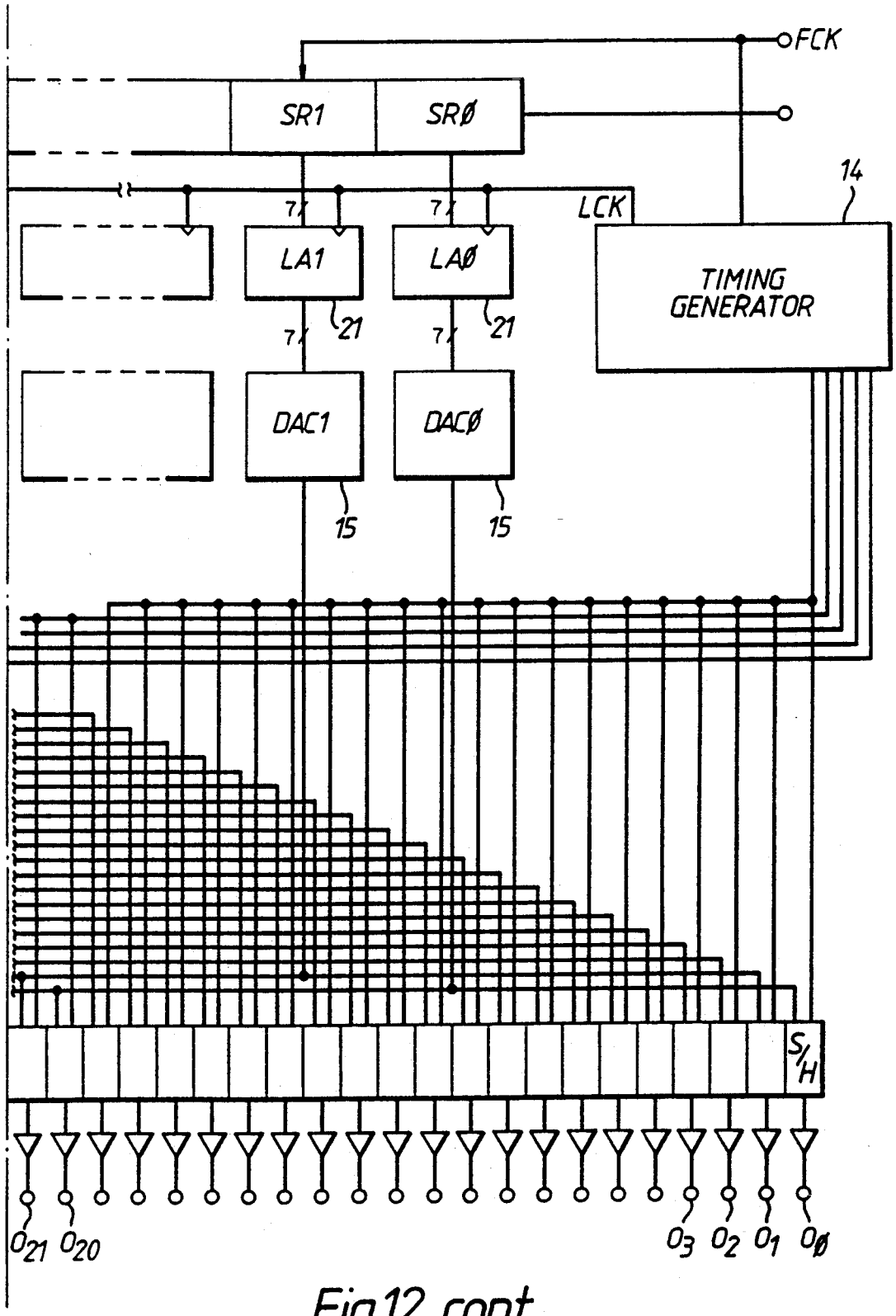
Figure 13:
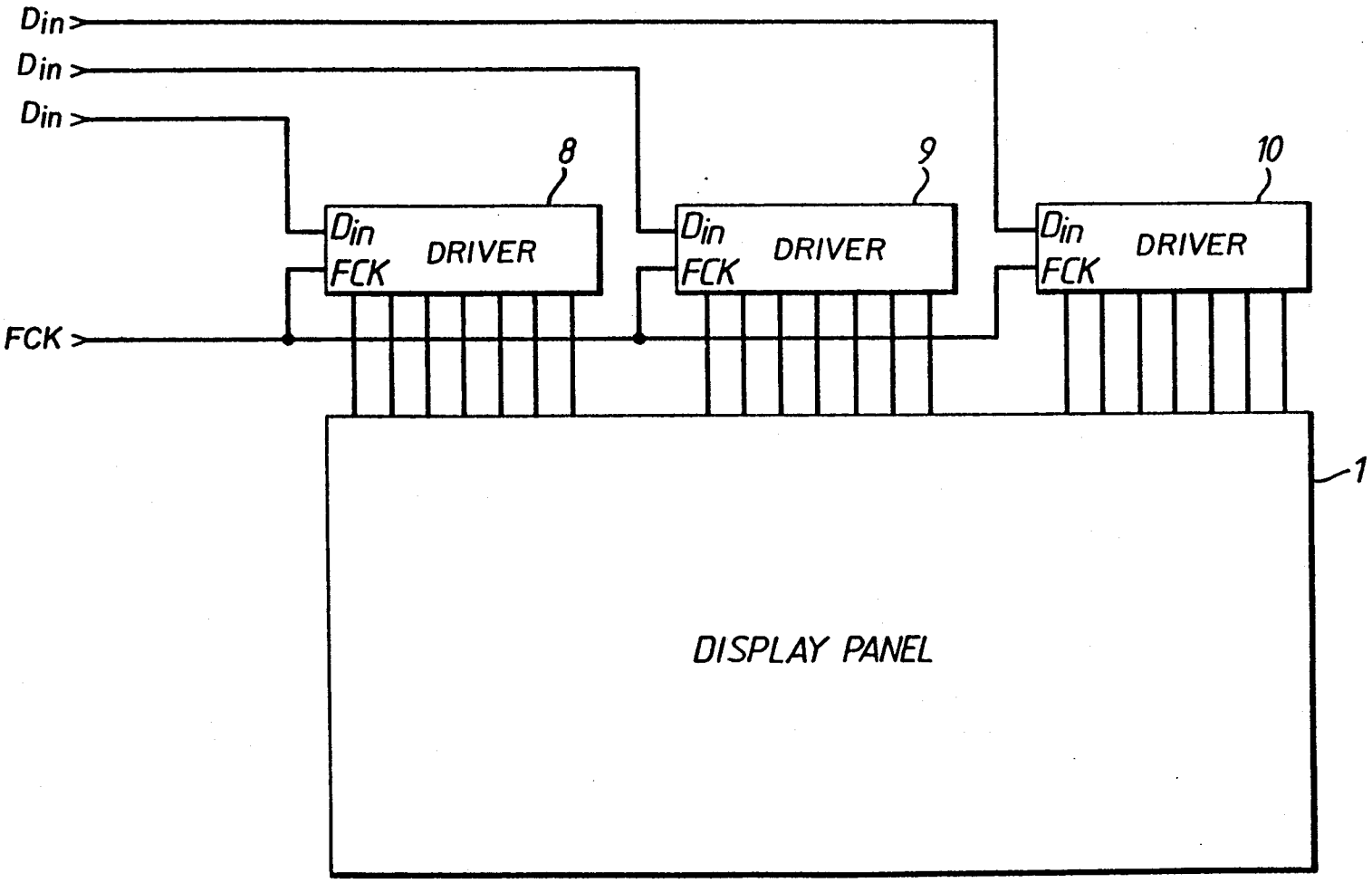
FIG. 13 shows a block diagram of a display device configuration with the X-driver ICs illustrated in FIG. 12.
Figure 14:
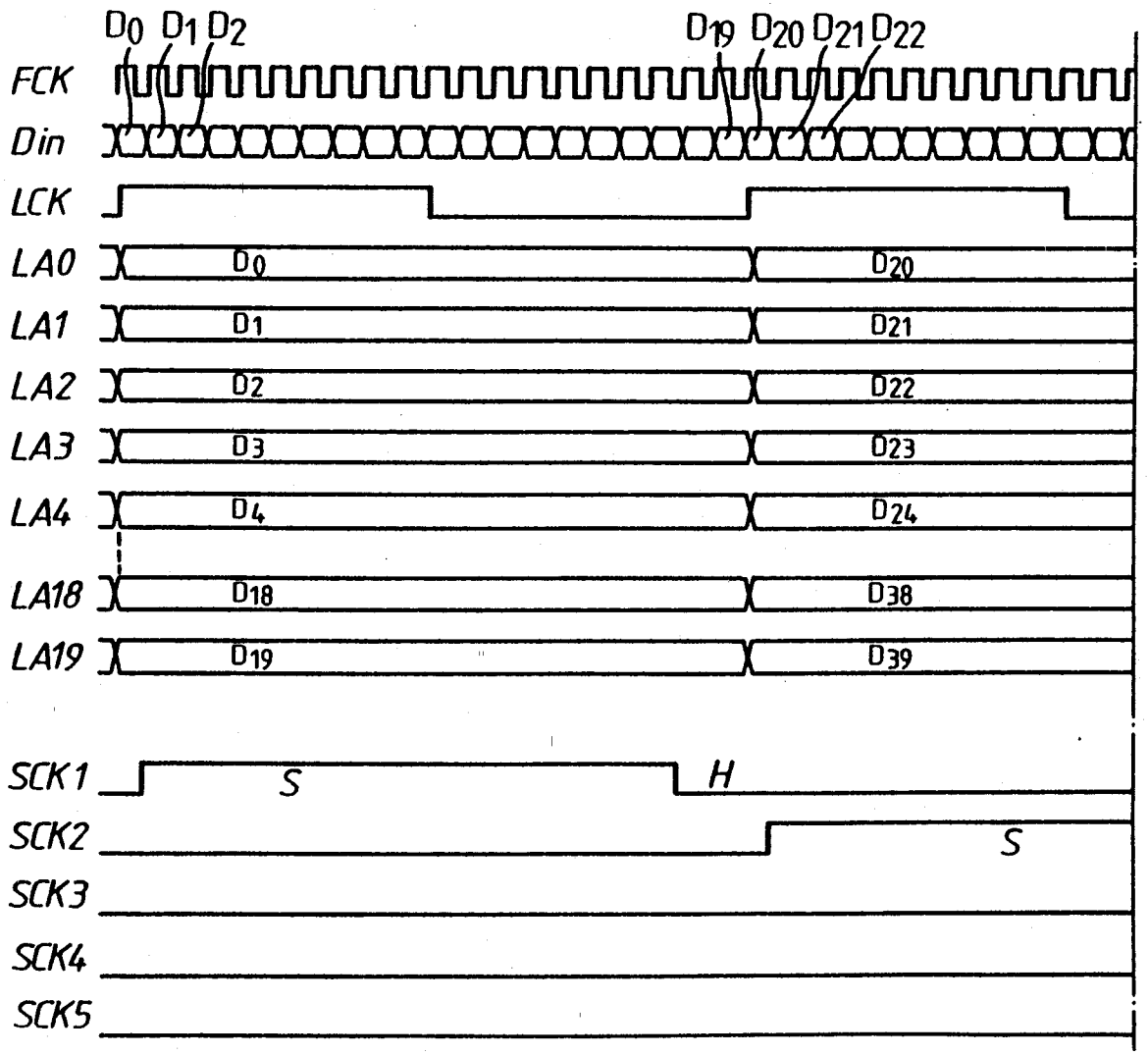
FIG. 14 is a timing chart for explaining the operation of the block diagram of FIG. 12 according to the present invention.
Figure 14:
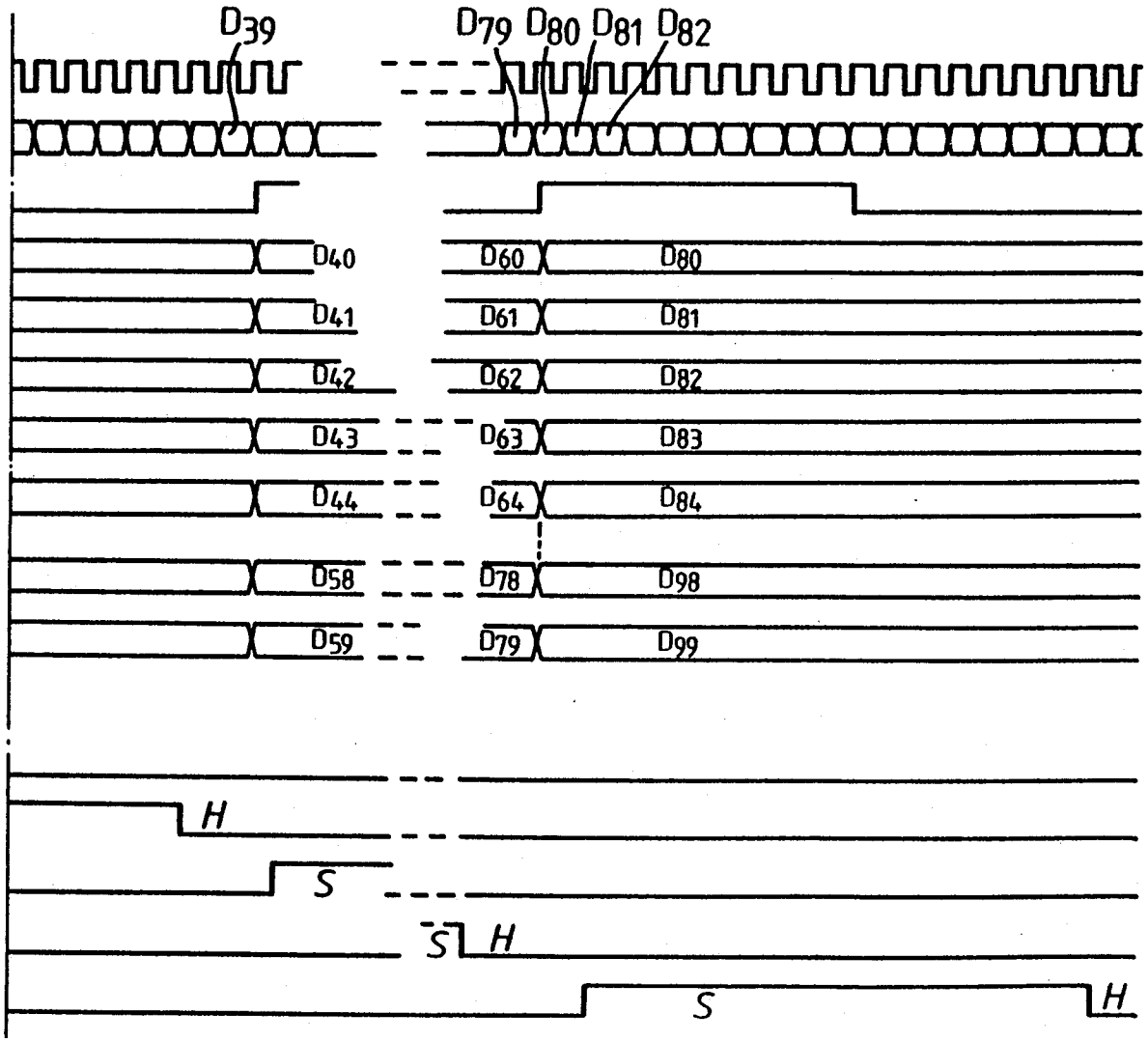

FIG. 12 shows a fourth example of the invention. The illustrated circuit configuration is a single IC Chip forming an X-driver circuit which can drive 100 data lines. As shown in FIG. 13, a plurality of such IC chips 8, 9, 10, etc., may be disposed on a single display panel 1. FIG. 14 is a timing diagram illustrating the operation of the circuit shown in FIG. 12.

Referring to FIG. 12, digital image signal Din is applied externally together with synchronizing clock pulses FCK. In this example, the signal Din represents each individual pixel by 7 bits of data and is applied to the first stage of 7-bit, 20 stage shift register 13. The data are successively shifted to the right in response to the synchronizing clock pulses FCK. The input digital image signal Din is supplied to IC chips 8, 9, 10, etc., shown in FIG. 13, such the signal Din applied to the next IC chip is shifted by 100 pixels with respect to the signal Din applied to the previous IC chip. Each synchronizing clock pulse FCK is applied whenever one pixel of digital image signal Din is applied. The clock pulses FCK are also supplied to a timing generation circuit 14.

Seven-bit latches 21 are disposed on the output side of shift register 13. Digital image signal Din for 20 pixels held in shift registers $SR_0$–$SR_{19}$ are accepted and latched in latches 21 in response to latch clock pulses LCK (FIG. 14) which are produced from the timing generator 14 whenever digital image signal Din corresponding to 20 pixels as $D_0$–$D_{19}$ $D_{20}$–$D_{39}$, etc., are applied. More specifically, each 7-bit latch holds the digital image signal corresponding to every 20 pixels.

The same number (in this example 20) of D/A converters 15 as latches 21 are coupled to the output of latches 21. D/A converters 15 receive digital signals from latches 21 and convert them into analog form at a period that is 20 times longer than the period of synchronizing clock pulses FCK, i.e., 20 is the number of D/A converters 15. The analog signals delivered from D/A converters 15 are immediately held in sample-and-hold circuits 16 in response to sampling clock pulses $SCK_1$–$SCK_5$ (FIG. 14).

More specifically, input digital image signals $D_0$–$D_{19}$ corresponding to the first 20 pixels are converted into analog form by D/A converters 15 and held in the first through twentieth sample-and-hold circuits 16 (as viewed from the right side). Then, input digital image signals $D_{20}$–$D_{39}$ corresponding to the next 20 pixels are converted into analog form by D/A converters 15 and held in the twenty-first through fortieth sample-and-hold circuits 16 (as viewed from the right side). The same process is repeated five times. As a result, input digital image signals $D_0$–$D_{99}$ for 100 pixels are all converted into analog form by D/A converters 15 and held in sample-and-hold circuits 16.

IC chips 8, 9, 10, etc., shown in FIG. 13 function similarly, so when analog image signals corresponding to 100 pixels are held in sample-and-hold circuits 16, it follows that the analog image signal corresponding to one horizontal scanning line is held by all of the integrated circuits. When analog signals for an entire horizontal scanning line are held in sample-and-hold circuits 16, an output enable signal (not shown) is supplied to deliver the analog signals to data lines 2 simultaneously via output buffers 17.

In the present example, the number of D/A converters 15 is less then the number of pixels N contained in one horizontal scanning line, in the same way as in the first through third examples. Additionally, the number of digital storage circuits constituted by shift register 13 and latches 21 is less than N. Therefore, where the circuit is fabricated in the form of an integrated circuit, the area of the chip can be reduced further. Moreover, the electric power consumed can be curtailed, since the number of stages of shift register 13 can be reduced.

Figure 15:
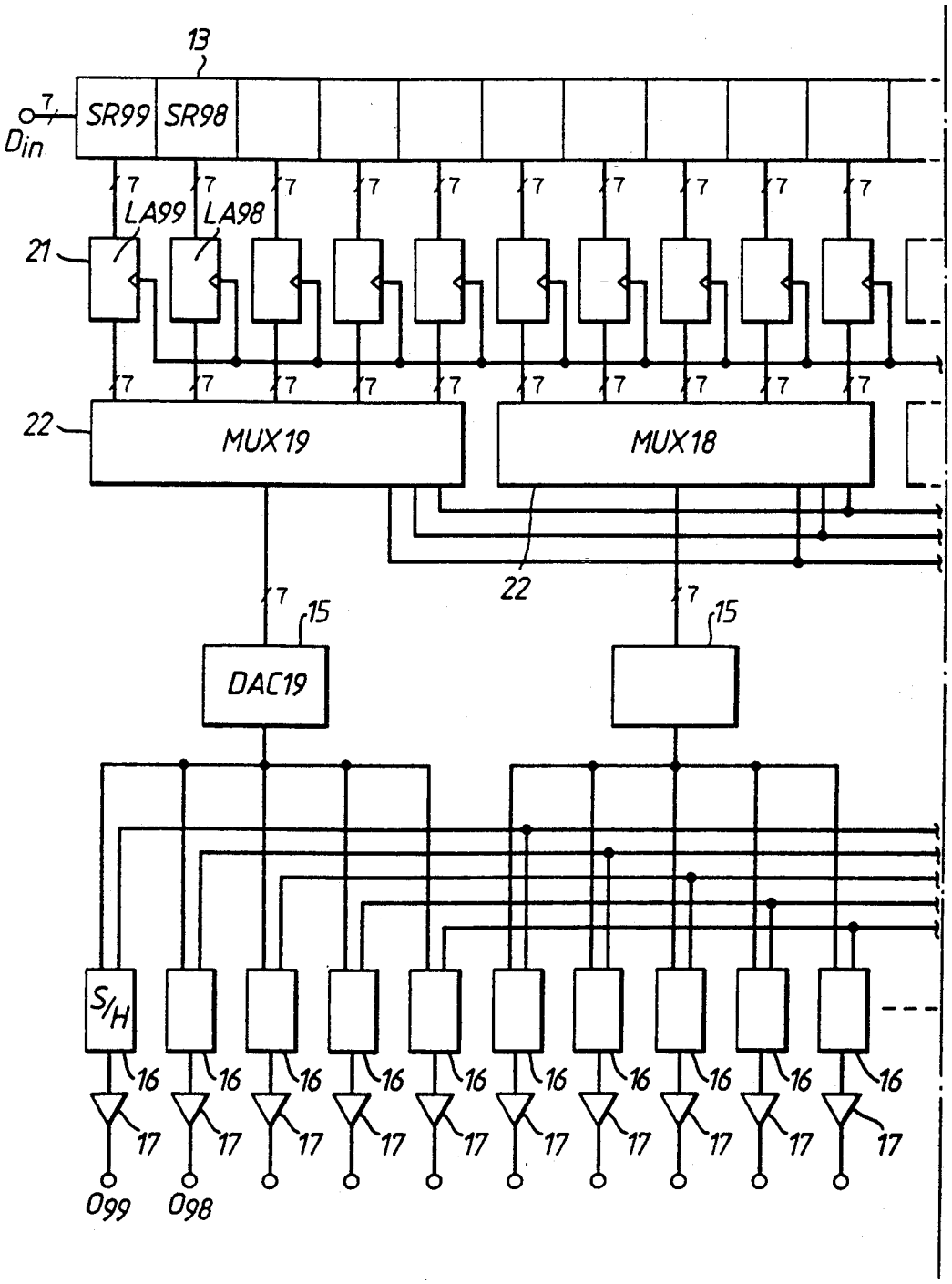
FIG. 15 is a block diagram of the fifth embodiment of a driver circuit according to the present invention.
Figure 15:
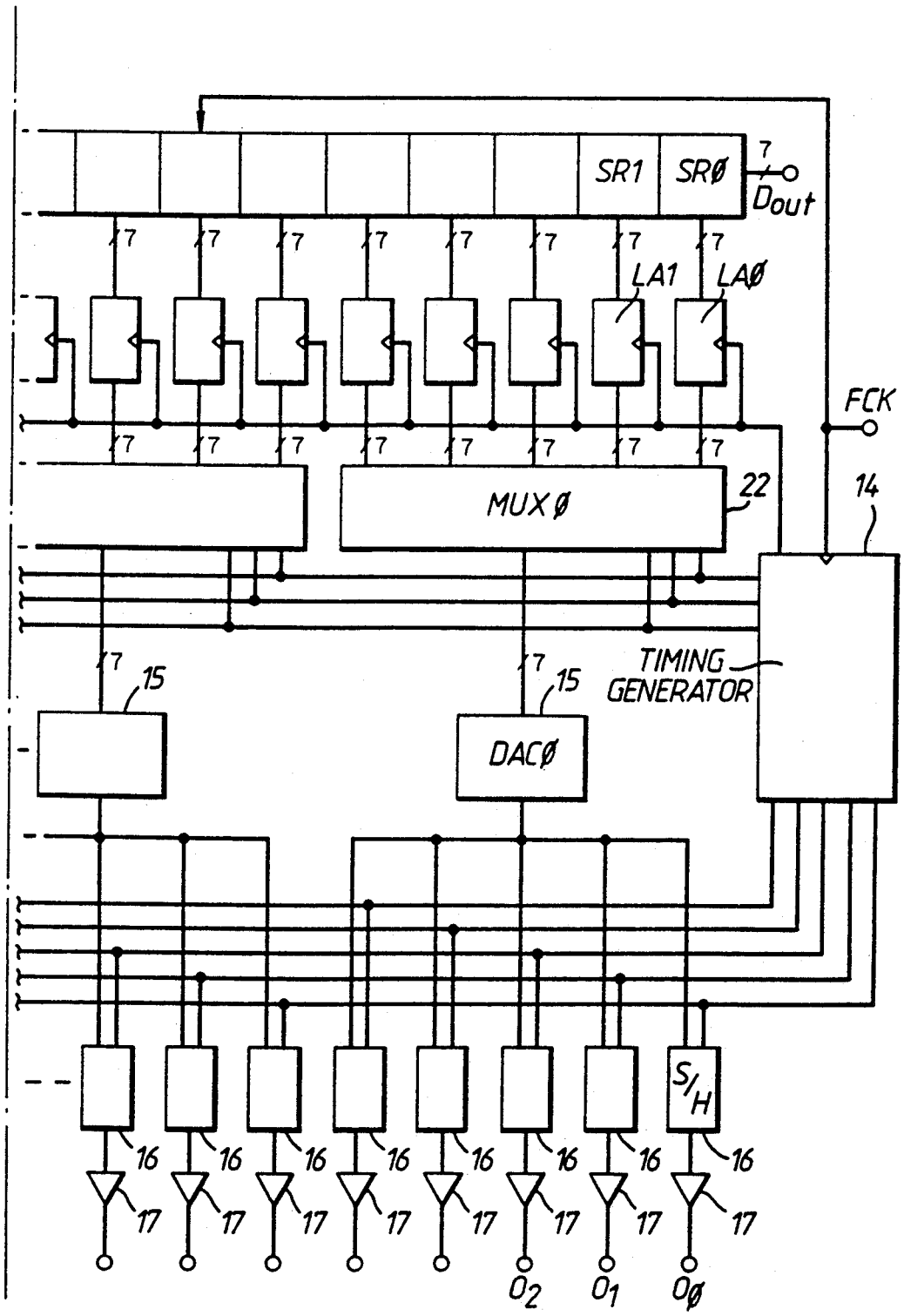
Figure 16:
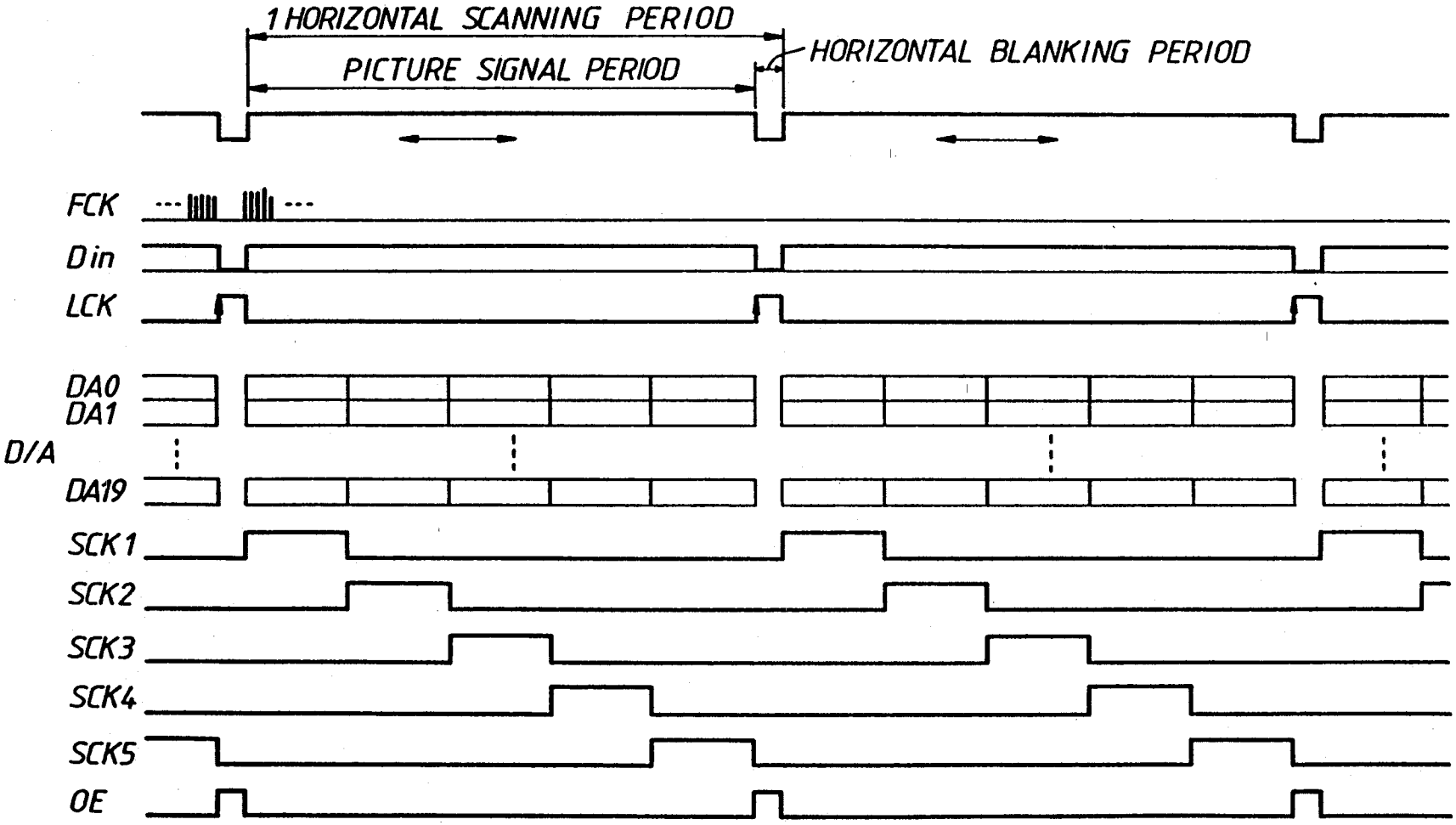
FIG. 16 is a timing chart for explaining the operation of the block diagram of FIG. 15 according to the present invention.

FIG. 15 shows a fifth example of the invention. This example is an X-driver circuit which is fabricated as an integrated circuit driving 100 data lines, in the manner as in the fourth example. FIG. 16 is a timing diagram illustrating its operation.

In this example, shift register 13 and latches 21 are provided, corresponding to pixels in the same way as in the first through third examples. In the example shown in FIG. 15 shift register 13 has 100 stages. In this case, IC chips 8, 9, 10, etc., are connected as shown in When digital image signals Din ($D_0$–$D_{99}$) are applied to all shift register the signals Din are transferred to latches 21 simultaneously as shown in FIG. 16 in response to a latch clock pulse LCK.

In this example, the outputs of latches 21 are grouped in blocks of 5. A multiplexer 22 is connected to the output of each block. In this example, the number of multiplexers 22 is 20. D/A converters 15 are connected to the outputs of the multiplexers. Digital image signals corresponding to 5 pixels are applied to multiplexers 22 and slowly and successively, i.e., pixel by pixel, delivered to D/A converters 15 and converted into analog form. The maximum period of time for the conversion is equal to the period of the digital image signal for one horizontal scanning line divided by the number of pixels assigned to one D/A converter 15, as shown in FIG. 16. The analog image signals delivered from D/A converters 15 are immediately held in sample-and-hold circuits 16 in response to sampling clock pulses $SCK_1$–$SCK_5$.

More specifically, when digital image signals for 100 pixels are latched in latches 21, input digital image signals $D_0$, $D_5$, etc., corresponding to every five pixels are selected by multiplexers 22 and converted into analog form by D/A converters 15. Then, the analog signals are retained in every fifth sample-and-hold circuit 16 as viewed from the right end. Then, input digital image signals $D_1$, $D_6$, etc., corresponding to the next group of every fifth pixel are selected by multiplexers 22 and converted into analog form by D/A converters 15. The resulting analog image signals are held in every fifth sample-and-hold circuit 16. Subsequently, input digital image signals Din corresponding to the next group of every fifth pixel is simultaneously selected by multiplexers 22 and converted into analog form by D/A converters 15. These analog image signals are held in sample-and-hold circuits 16. Eventually, input digital image signals $D_0$–$D_{99}$ corresponding to 100 pixels are all converted into analog form by D/A converters 15 and held in sample-and-hold circuits 16.

Figure 17:
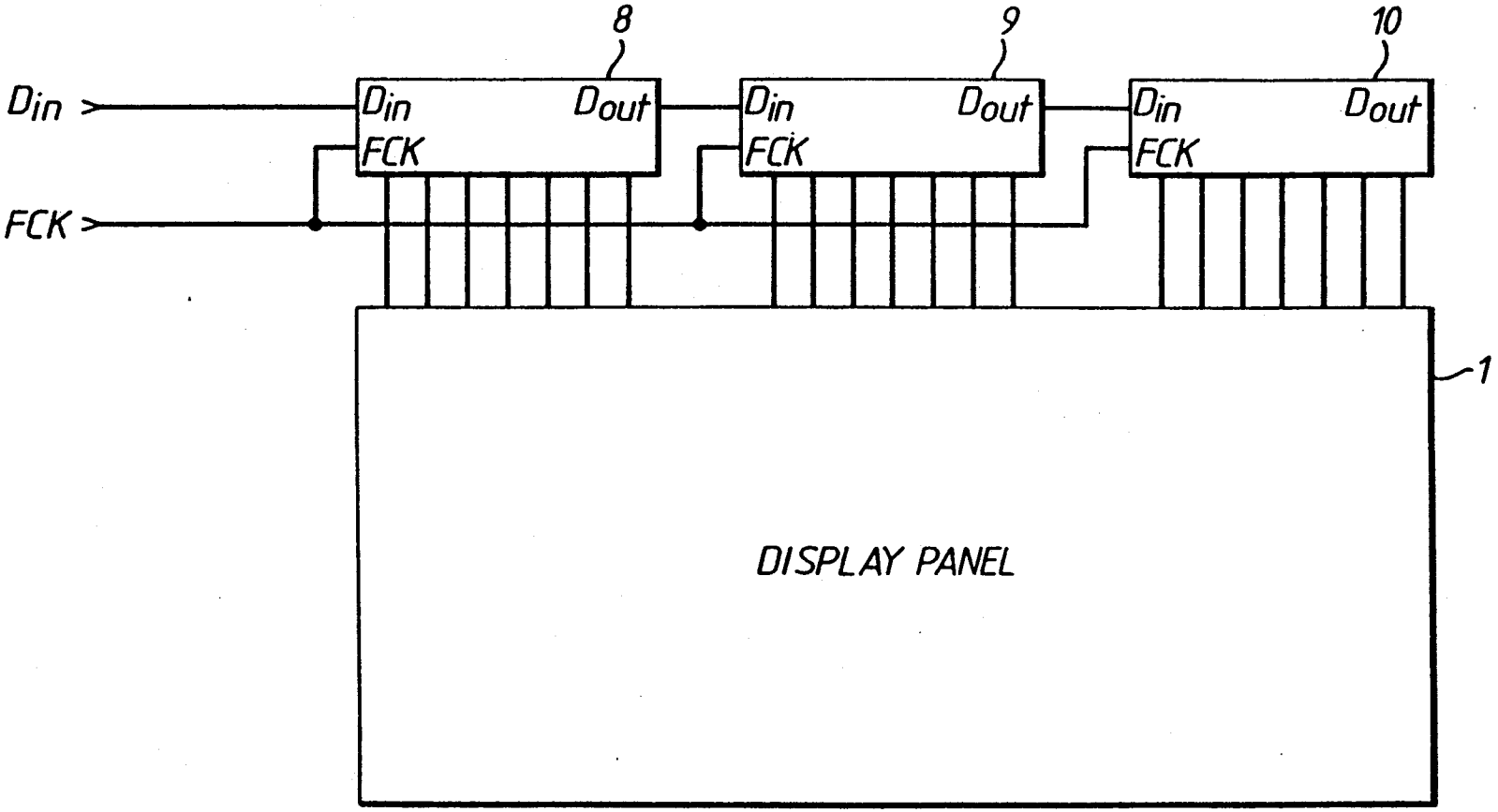
FIG. 17 shows a block diagram of a display device configuration with X-driver ICs illustrated in FIG. 15.

IC chips 8, 9, 10, etc., shown in FIG. 17 function in a corresponding manner. When analog image signals corresponding to 100 pixels are held in sample-and-hold circuits 16, it follows that analog image signals corresponding to one horizontal scanning line is held by all of the integrated circuits. Then, output enable signal OE is supplied to deliver the analog image signals to data lines 2 simultaneously via output buffers 17.

In accordance with the present invention, the sampling period of the N sample-and-hold circuits 16 can be set to a long period that is equal to the digital image signal period of one horizontal scanning line divided by the number of pixels contained in the input digital image signal assigned to one of D/A converters 15.

Therefore, this example provides the same advantages as the first through third examples. Since digital image signals Din are distributed among D/A converters 15 by multiplexers 22, it is unlikely that wires for conveying analog signals among the D/A converters and sample-and-hold circuits 16 intersect each other in a complicated manner. Rather, the lengths of the wires are substantially uniform. Consequently, the signal transmission characteristics vary only a little among the wires.

Figure 18:
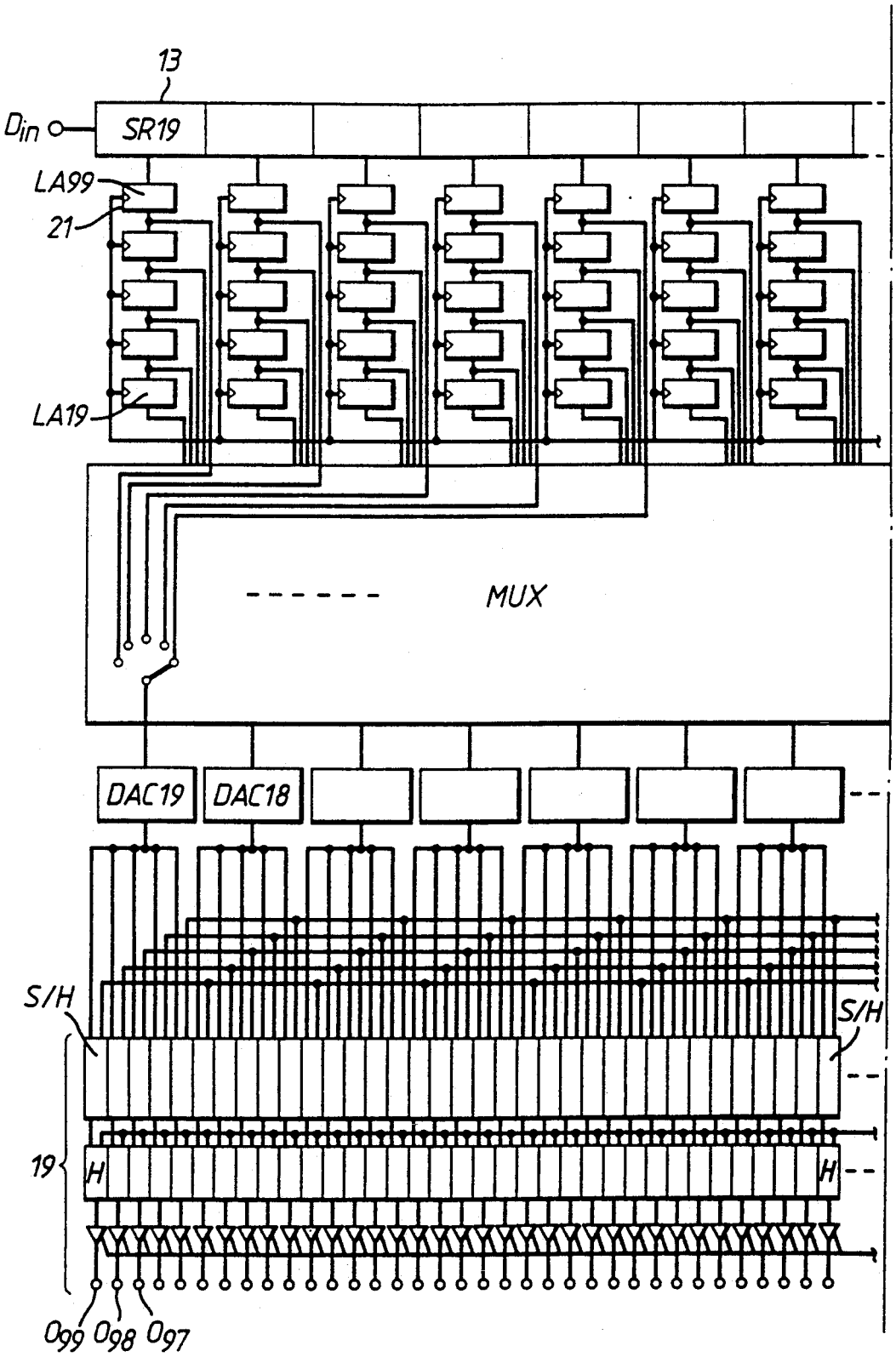
FIG. 18 is a block diagram of the sixth embodiment of a driver circuit according to the present invention.
Figure 18:
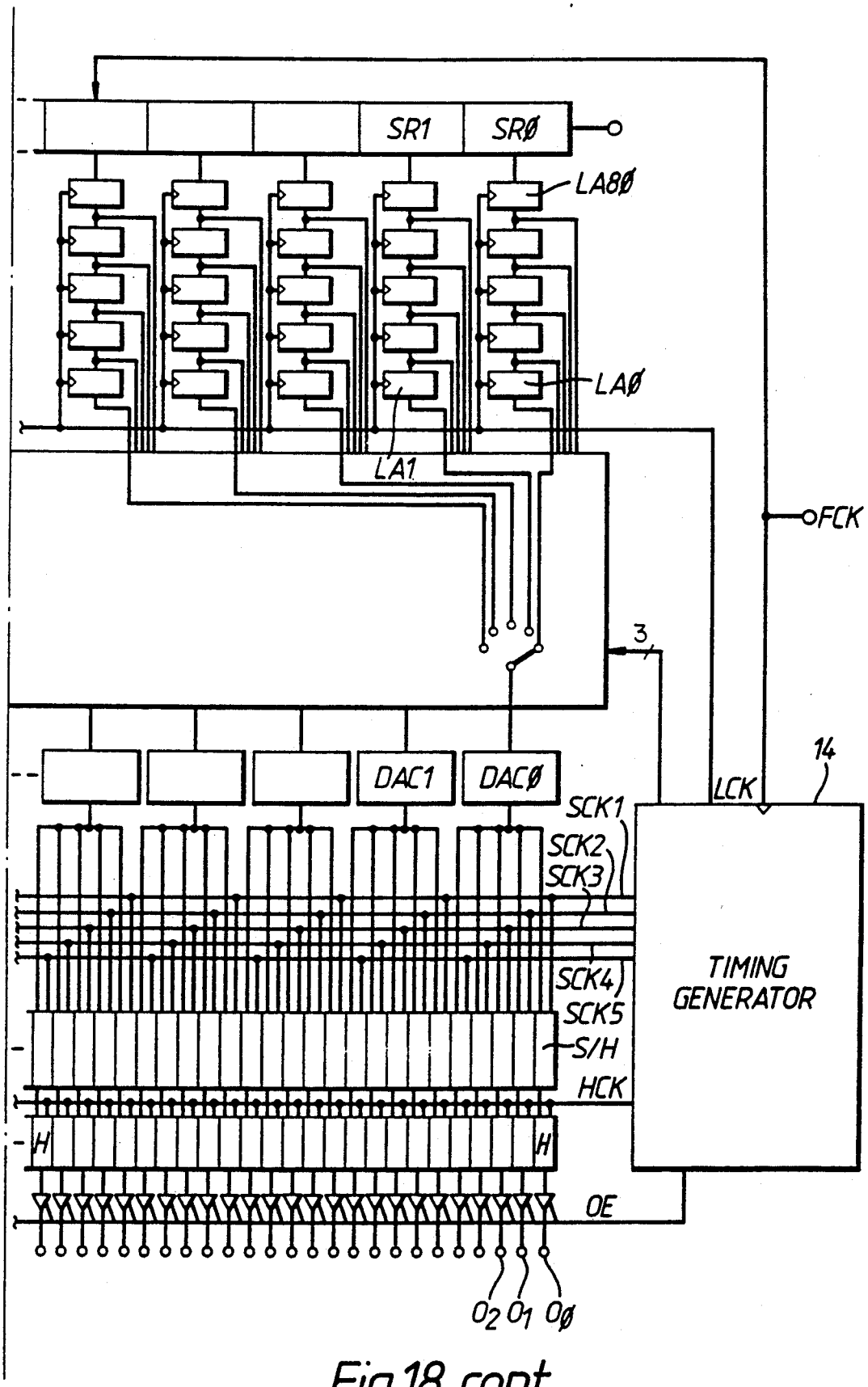
Figure 19:
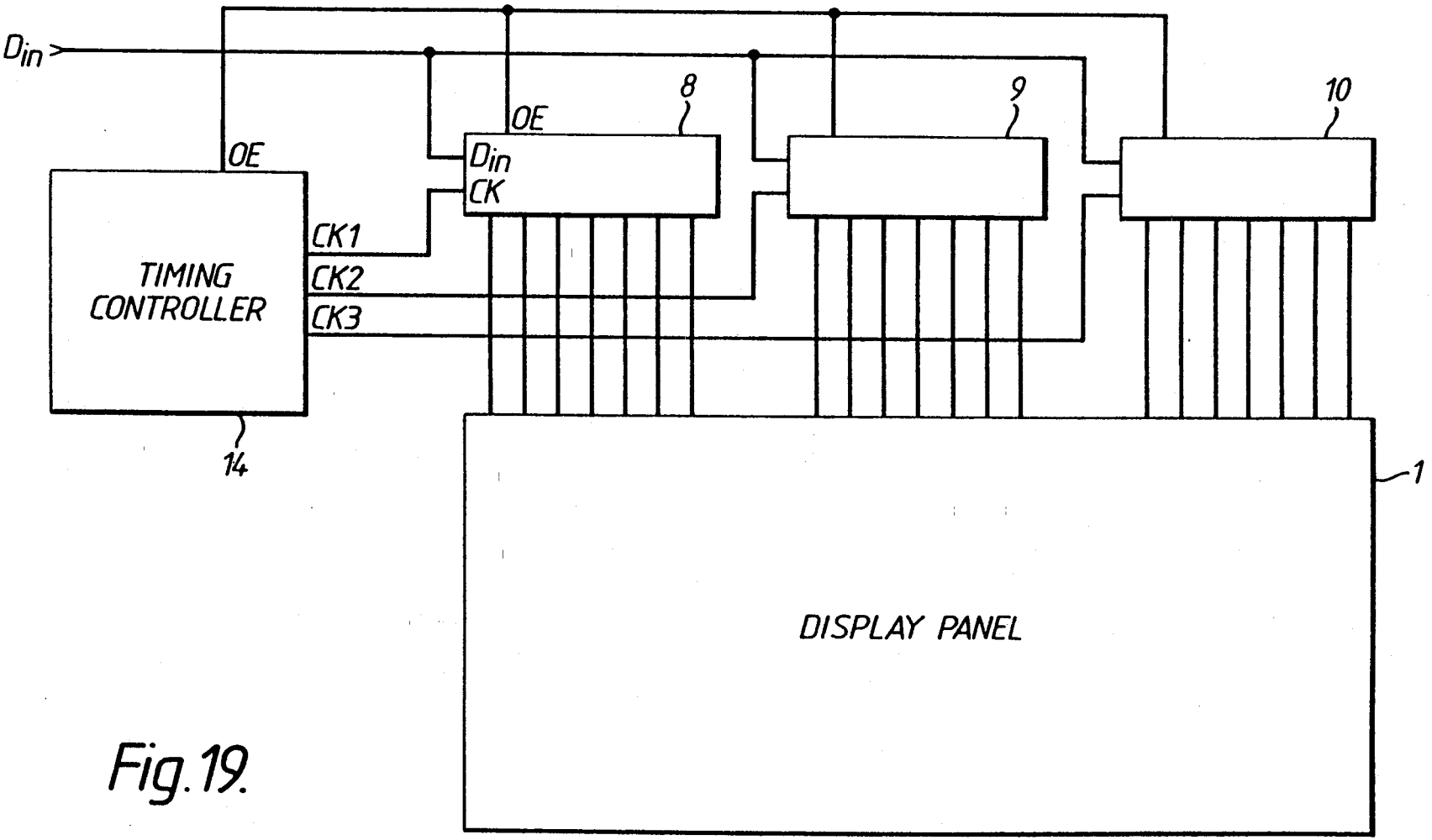
FIG. 19 shows an outline of a block diagram configuration with X-driver ICs illustrated in FIG. 18.
Figure 20:
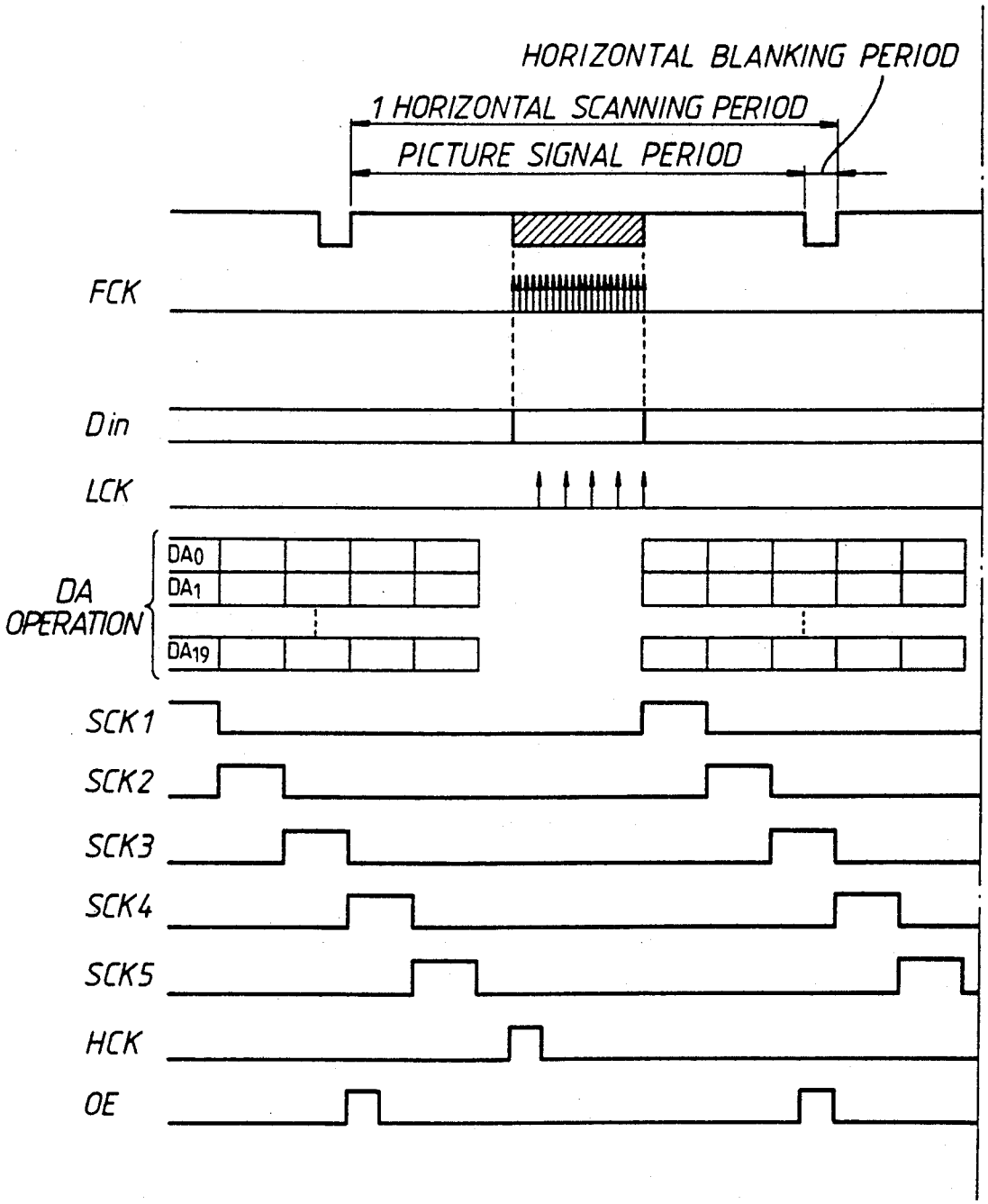
FIG. 20 is a timing chart for explaining the operation of the block diagram of FIG. 18 according to the present invention.
Figure 20:
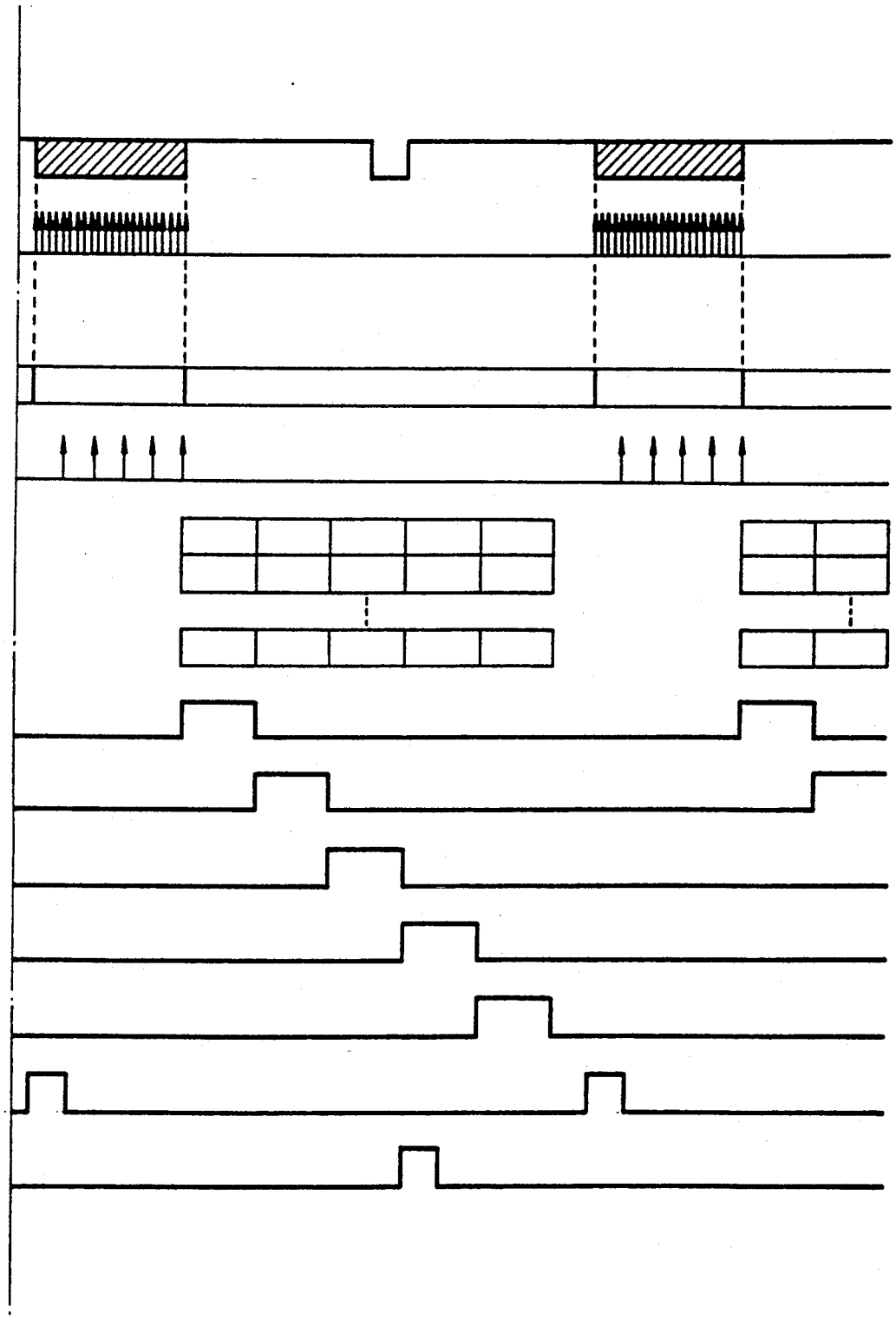

FIG. 18 shows a sixth example of the invention. This example is an X-driver circuit fabricated in the form of an integrated circuit chip driving 100 data lines, in the same manner as in the fourth and fifth examples. IC chips 8, 9, 10, etc., are connected as shown in FIG. 19. FIG. 20 is a timing diagram illustrating the operation of the circuit shown in FIG. 18. Each hatched portion indicates events associated with one IC chip.

In this example, twenty stage, 7-bit shift register 13, is mounted in the same manner as in the fourth example. Latches 21 are mounted, corresponding to the pixels, in the same way as in the fifth example. In the example shown in FIG. 18, the number of latches is 100. Whenever digital image signals Din corresponding to 20 pixels such as $D_0$–$D_{19}$, $D_{20}$–$D_{39}$, are applied to shift register 13, the digital image signals are transferred to latches 21 in response to a latch clock pulse LCK produced by a timing generator 14.

When input digital image signals Din corresponding to one horizontal scanning line, or $D_0$–$D_{99}$, are accepted by latches 21, each data item corresponding to each pixel is successively delivered to 20 D/A converters 15 slowly. The maximum interval of time is equal to the digital image signal period corresponding to one horizontal scanning line divided by the number of pixels contained in the input digital image signal assigned to one D/A converter 15, as shown in FIG. 20. The analog image signals delivered from D/A converters 15 are immediately held in sample-and-hold circuits 19 having a double holding function in response to sampling clock pulses $SCK_1$–$SCK_5$. When analog image signals corresponding to all the pixels are held in sample-and-hold circuits 19, these signals are delivered to the data lines 2 in response to output enable signal OE.

The present invention as embodied in the sixth example yields the same advantages as the fifth example. Since the number of stages of shift register 13 is less then N, it is easy to fabricate the X-driver circuit in the form of an IC. Further, the electric power consumed is small.

Figure 21:
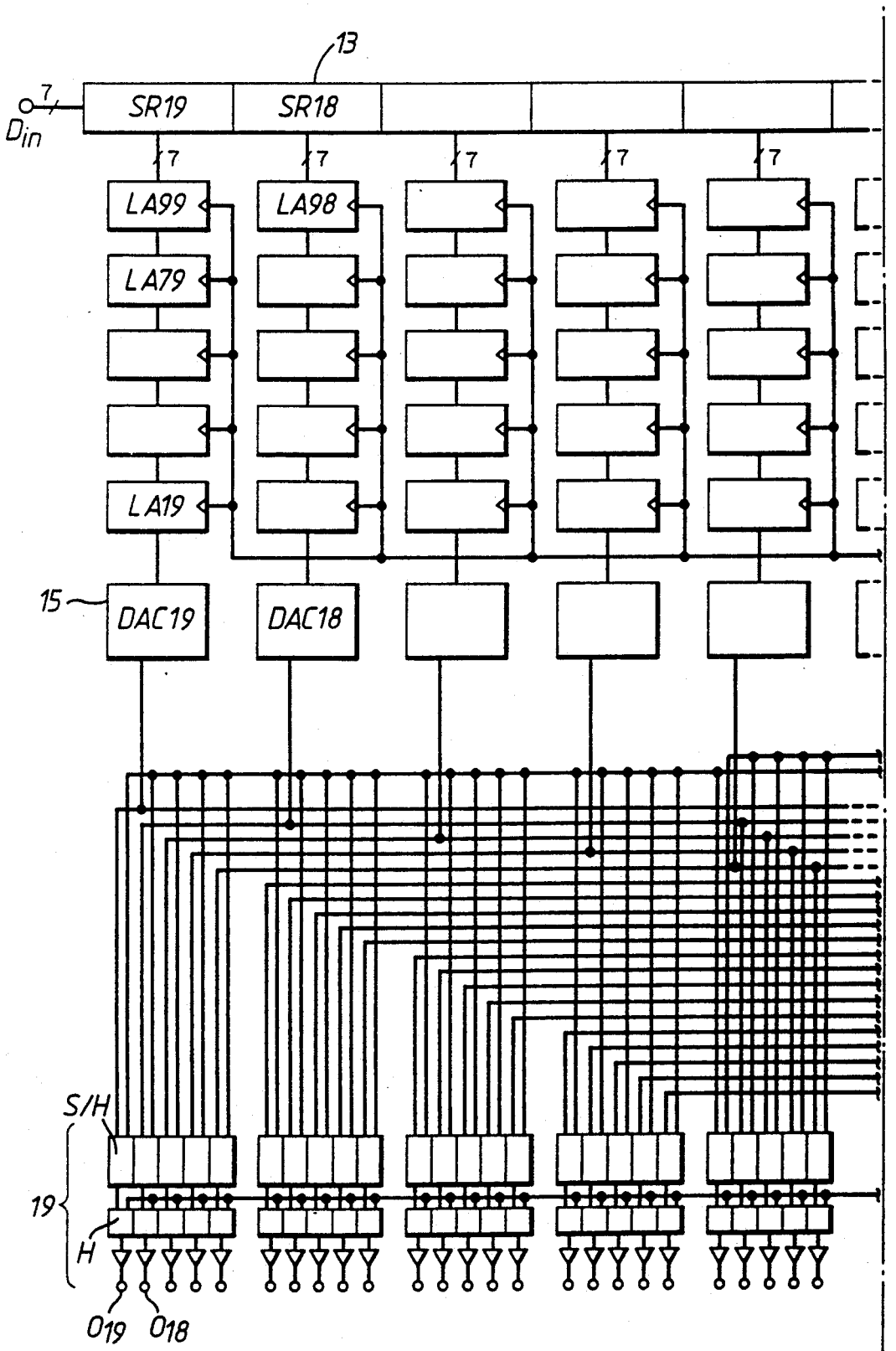
FIG. 21 is a block diagram of the seventh embodiment of a driver circuit according to the present invention.
Figure 21:
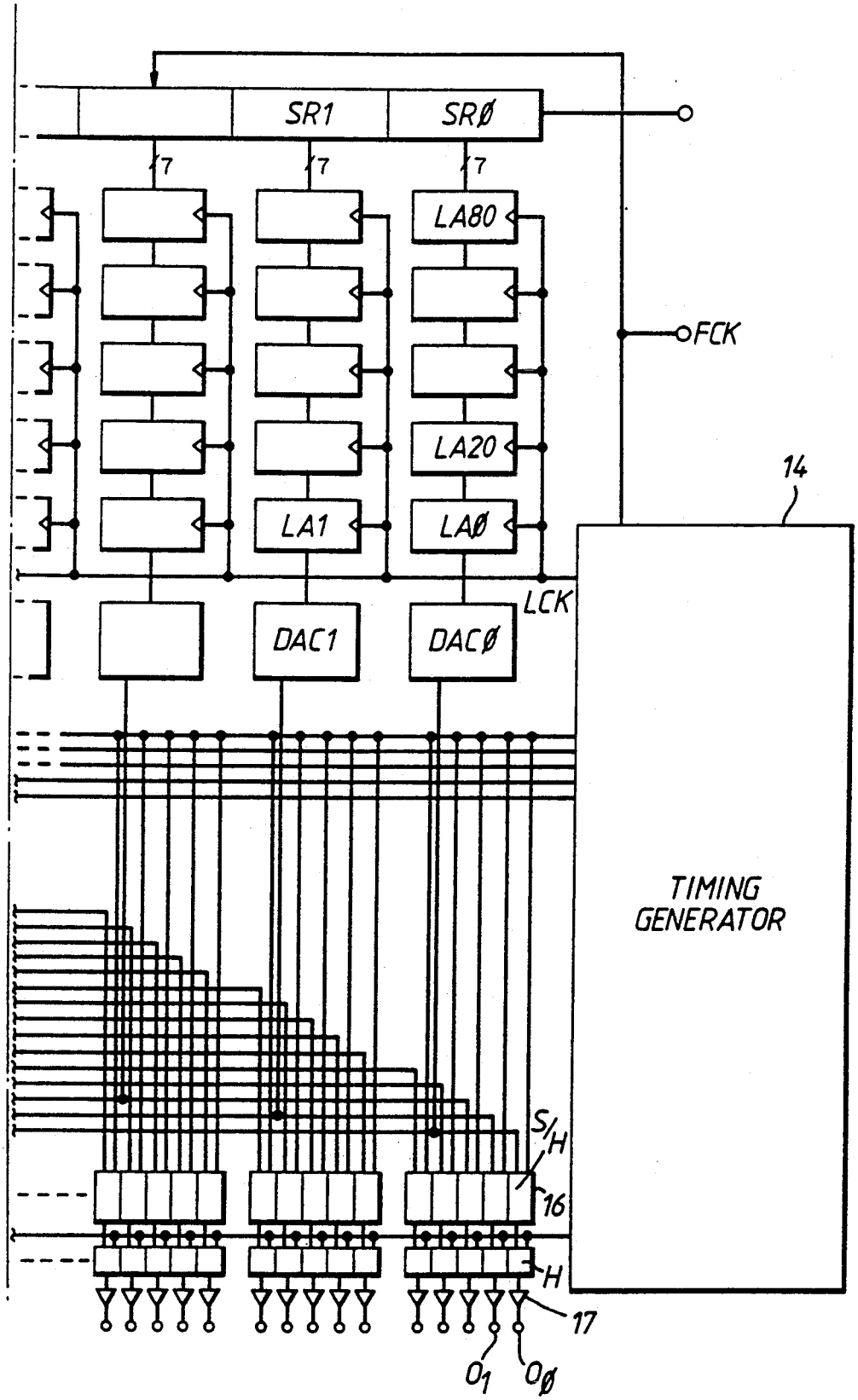
Figure 22:
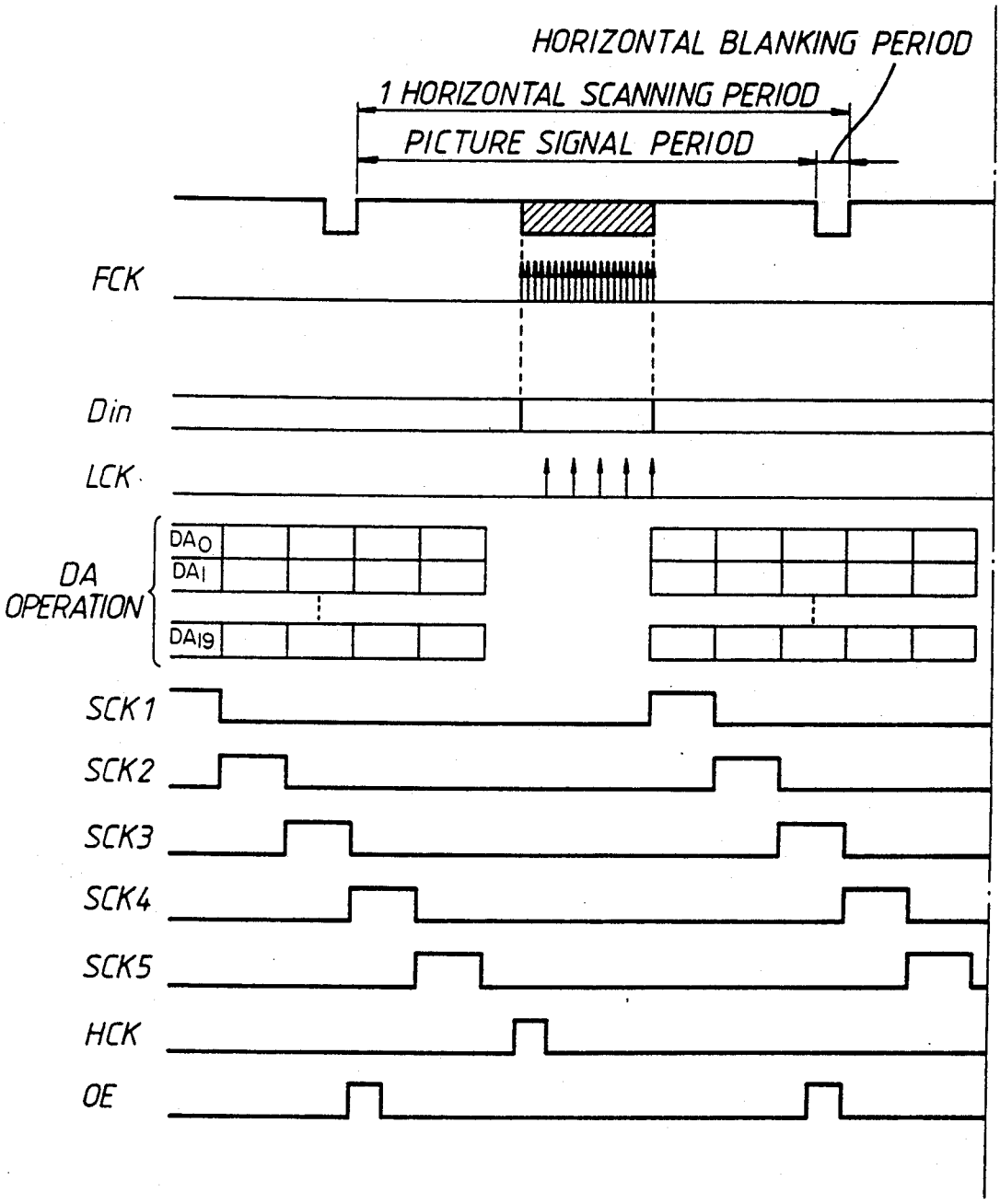
FIG. 22 is a timing chart for explaining the operation of the block diagram of FIG. 21 according to the present invention.
Figure 22:
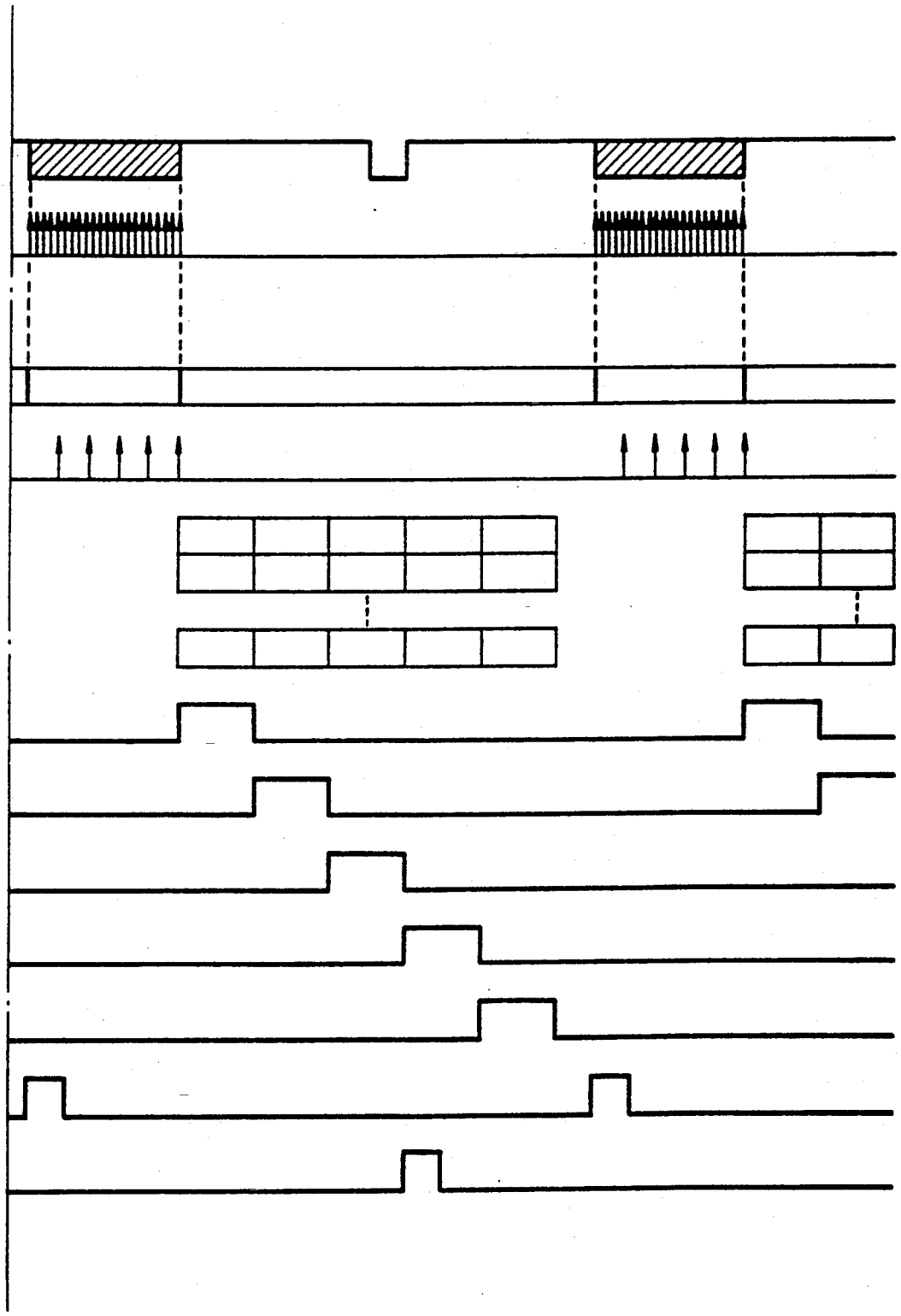

FIG. 21 shows a seventh example of the invention. In this example, multiplexers 22 (FIG. 18) of the sixth example are omitted and the output signals from latches 21 are directly supplied to D/A converters 15. In this case, wires transmitting analog signals among D/A converters 15 and sample-and-hold circuits 19 are complex, but the circuit size is smaller than the circuit of the sixth example, since no multiplexers are needed. Also, this example is more adapted for an integrated circuit. IC chips 8, 9, 10 etc., may be connected as shown in FIG. 19. FIG. 22 is a timing diagram illustrating the operation of the circuit shown in FIG. 21. Each hatched portion indicates a portion assigned to one IC chip.

In the fourth and fifth examples, sample-and-hold circuits 16 can be replaced with sample-and-hold circuits 19 having a double holding function as shown in FIGS. 7–8.

In accordance with the present invention, the number of requisite D/A converters can be made small so that the circuit size is small. This makes it easy to fabricate the driver circuit in the form of an IC.

Since analog image signals delivered from D/A converters can be slowly applied to sample-and-hold circuits, the sampling period of the sample-and-hold circuits can be rendered long, and the offset voltage can be made low. Hence, the image quality can be improved. Furthermore, many modification and variations of the embodiments explained may be made without departing from the novel and advantageous features of this invention. Accordingly, all such modifications and variations are intended to be included within the scope of the appended claims.

What is claimed is:

1. A driver for a display having plural scan lines of N pixels comprising:

M digital-to-analog (D/A) converters, said number M being less than the number of pixels N contained in one scan line;

digital storage means for storing input digital image signals corresponding to at least said one scan line, and for distributing M pixels represented by said input digital image signals to said M D/A converters simultaneously;

analog holding means for holding analog image signals delivered from said D/A converters; and delivering means for delivering said analog image signals held in said analog holding means to said display.

2. The display device according to claim 1, wherein said digital storage means comprises multiplexer means for distributing said input image signals to said D/A converters.

3. The drive according to claim 1, wherein:

said digital storage means comprises M shift registers having each n bits and N/M stages, where n is the number of bits in said input digital image signal for each pixel; and said driver further comprises means for causing said shift registers to deliver each group of M pixels of data to said D/A converters sequentially.

4. The driver according to claim 1, wherein said digital storage means comprises a shift register having n bits and N stages, where n is the number of bits in said input digital image signal for each pixel, and said shift register sequentially delivers said digital image signal to said D/A converters from a predetermined M stages.

5. The display device according to claim 4, wherein said digital storage means comprises multiplexer means for distributing said input image signals to said D/A converters.

6. The driver according to claim 1, wherein said digital storage means comprises a shift register having n bits and M stages, where n is the number of bits in said input digital image signal for each pixel, and M latches, each connecting one stage of said shift register to one of said digital-to-analog converters.

7. The display device according to claim 6, wherein said digital storage means comprises multiplexer means for distributing said input image signals to said D/A converters.

* * * * *